US007730738B2

(12) United States Patent
Park et al.

(10) Patent No.: US 7,730,738 B2
(45) Date of Patent: Jun. 8, 2010

(54) COOL AIR SUPPLY DUCT OF REFRIGERATOR

(75) Inventors: Kyong Bae Park, Seoul (KR); Jang Seok Lee, Inchun-si (KR)

(73) Assignee: LG Electronics Inc., Seoul (KR)

( * ) Notice: Subject to any disclaimer, the term of this patent is extended or adjusted under 35 U.S.C. 154(b) by 997 days.

(21) Appl. No.: 11/397,674

(22) Filed: Apr. 5, 2006

(65) Prior Publication Data

US 2007/0101757 A1 May 10, 2007

(30) Foreign Application Priority Data

Nov. 10, 2005 (KR) ..... 10-2005-0107692

(51) Int. Cl.
*F25D 17/04* (2006.01)

(52) U.S. Cl. ..... 62/407; 62/448

(58) Field of Classification Search ..... 62/407, 62/408, 448, 187

See application file for complete search history.

(56) References Cited

U.S. PATENT DOCUMENTS 6,006,529 A * 12/1999 Ji et al. ..... 62/186
6,131,403 A * 10/2000 Ji ..... 62/186
6,622,504 B2 9/2003 Lee et al.
6,837,066 B2 1/2005 Cho et al.
6,848,264 B2 2/2005 Lee et al.

* cited by examiner

*Primary Examiner*—Melvin Jones
(74) *Attorney, Agent, or Firm*—Birch, Stewart, Kolasch & Birch, LLP

(57) ABSTRACT

A cool air supply duct of a refrigerator includes a vertical duct unit installed in a freezing chamber or a refrigerating chamber of the refrigerator so that the length of the vertical duct unit can be adjusted in the vertical direction; and horizontal duct units installed on the vertical duct unit so that the length of the horizontal duct unit can be adjusted in the horizontal direction and provided with cool air discharge holes formed therethrough for discharging cool air. Since the cool air discharge holes are changed to positions desired by a user, the cool air supply duct cools a designated space of the freezing chamber or the refrigerating chamber of the refrigerator to a temperature lower or higher than those of other spaces, thus increasing convenience in using the cool air supply duct and improving the cooling efficiency of the cool air supply duct.

20 Claims, 17 Drawing Sheets

COOL AIR SUPPLY DUCT OF REFRIGERATOR

BACKGROUND OF THE INVENTION

1. Field of the Invention

The present invention relates to a cool air supply duct of a refrigerator, and more particularly to a cool air supply duct of a refrigerator, in which positions of cool air discharge holes for supplying cool air to a freezing chamber or a refrigerating chamber are changeable.

2. Description of the Related Art

Generally, refrigerators are apparatuses, in which a refrigerating cycle device comprising a compressor, a condenser, an expansion device, and an evaporator is installed for supplying air cooled by the evaporator to storage chambers, such as freezing and refrigerating chambers.

Recently, a cool air supply duct, which has a plurality of cool air discharge holes and is installed in the freezing or refrigerating chamber, is used to supply cool air with three-dimensional freedom.

FIG. 1 is a schematic sectional view of a conventional cool air supply duct of a refrigerator, and FIG. 2 is a perspective view of the conventional cool air supply duct of the refrigerator.

As shown in FIG. 1, a cool air supply duct 10 for supplying cool air to a freezing or refrigerating chamber of a refrigerator 1 is buried in one side wall of the freezing or refrigerating chamber, and a plurality of racks 20 and 30, which are separated from each other in the vertical direction, are installed in the freezing or refrigerating chamber of the refrigerator 1.

As shown in FIGS. 1 and 2, the cool air supply duct 10 comprises a plurality of cool air discharge holes, which are separated from each other in the vertical or horizontal direction.

Generally, at least one rack is installed. The vertical position of the rack is adjustable.

For example, when the upper rack 20 and the lower rack 30 are provided, the upper rack 20 may upwardly move from the position of SU to the position of SU' or downwardly move from the position of SU to the position of SU", and the lower rack 30 may upwardly move from the position of SL to the position SL' or downwardly move from the position of SL to the position of SL".

Generally, the cool air discharge holes 12, 14 and 16 are located close to the racks 20 and 30 so as to supply cool air to the lower portions of the racks 20 and 30 or food stored therein. Since the positions of the cool air discharge holes 12, 14 and 16 are fixed, when a user changes the positions of the racks 20 and 30 according to sizes of food, the cool air discharge holes 12, 14 and 16 may be closed by the racks 20 and 30 or the food, thereby being incapable of discharging cool air.

That is, an interval between the upper and lower racks 20 and 30 is changed so that the racks 20 and 30 can store various-sized objects. Further, since the shapes of the racks 20 and 30 are different, when the positions of the racks 20 and 30 are arbitrarily changed, the racks 20 and 30 may close the cool air discharge holes 12, 14 and 16.

When a part of the cool air discharge holes 12, 14 and 16 (here, the cool air discharge hole 14) is closed, cool air is concentrated onto other cool air discharge holes 12 and 16 so that designated food stored in the cool air discharge holes 12 and 16 can be supercooled, and the distribution of temperature in the freezing or refrigerating chamber is not uniform so that the cooling efficiency of the refrigerator is lowered, thereby causing the stored food to rot.

Further, when the upper rack 20 downwardly moves from the position SU to the position SU" and the lower rack 30 upwardly moves from the position of SL to the position SL', cool air is not discharged to a middle space of A, thereby causing a difficulty in maintaining the freshness of food stored in the middle space of A.

The cool air supply duct 10 is buried in one side wall of the freezing or refrigerating chamber, thereby increasing an adiabatic loss at the portion of the side wall in which the cool air supply duct 10 is buried.

SUMMARY OF THE INVENTION

Therefore, the present invention has been made in view of the above problems, and it is an object of the present invention to provide a cool air supply duct, in which cool air discharge holes for supplying cool air to a freezing chamber or a refrigerating chamber are moved to positions desired by a user so as to cool a designated space of the freezing chamber or the refrigerating chamber to a temperature lower or higher than those of other spaces, thereby increasing convenience in using the cool air supply duct and improving cooling efficiency of the cool air supply duct.

It is another object of the present invention to provide a cool air supply duct of a refrigerator, in which cool air discharge holes are not closed by racks or foods even when positions of the racks or the food are changed, thereby preventing the food located at a designated space from rotting.

It is yet another object of the present invention to provide a cool air supply duct of a refrigerator, which minimizes an adiabatic loss of the refrigerator.

In accordance with one aspect of the present invention, the above and other objects can be accomplished by the provision of a cool air supply duct of a refrigerator comprising: a vertical duct unit installed in a freezing chamber or a refrigerating chamber of the refrigerator so that the length of the vertical duct unit can be adjusted in the vertical direction; and horizontal duct units installed on the vertical duct unit so that the length of the horizontal duct unit can be adjusted in the horizontal direction and provided with cool air discharge holes formed therethrough.

The vertical duct unit may comprise a plurality of vertical ducts, at least one of which slides in the vertical direction.

Second cool air discharge holes may be formed through at least one of a plurality of the vertical ducts.

The cool air supply duct may further comprise opening and closing members for opening and closing the second cool air discharge holes.

A plurality of the vertical ducts may comprise a stationary vertical duct fixedly installed in at least one of the freezing chamber and the refrigerating chamber; and movable vertical ducts, at least one of which is slidably installed on the stationary vertical duct in the vertical direction.

The stationary vertical duct may be larger than the movable vertical ducts so that the movable vertical ducts are partially inserted into the stationary vertical duct.

The movable vertical ducts may be slidably inserted into each other in the vertical direction.

Sizes of the movable vertical ducts may be gradually decreased in the direction of increasing the length of the vertical duct unit so that one of the movable vertical ducts is partially inserted into another of the movable vertical ducts.

The cool air supply duct may further comprise elevating units for ascending and descending at least one of the movable vertical ducts.

The horizontal duct units may be disposed in parallel on at least one side of the left and right of the vertical duct unit.

The horizontal duct units may be disposed on the vertical duct unit so that the horizontal ducts are vertically separated from each other.

Each of the horizontal duct units may comprise a stationary horizontal duct communicated with the inside of the vertical duct unit and protruded from the vertical duct unit; and a movable horizontal duct slidably inserted into the stationary horizontal duct and provided with the cool air discharge holes formed therethrough.

The cool air discharge holes may be formed through each of the movable horizontal ducts at designated positions so that the cool air discharge holes are closed by the stationary horizontal duct when the movable horizontal ducts are slidably inserted into the stationary horizontal ducts in the horizontal direction.

The cool air supply duct may further comprise reciprocating units for sliding the movable horizontal ducts in the horizontal direction.

In accordance with another aspect of the present invention, there is provided a cool air supply duct of a refrigerator comprising: a stationary vertical duct fixedly installed in at least one of a freezing chamber and a refrigerating chamber of the refrigerator; movable vertical ducts slidably installed on the stationary vertical duct in the vertical direction; stationary horizontal ducts respectively protruded from both side surfaces of the stationary and movable vertical ducts; and movable horizontal ducts slidably disposed on the corresponding stationary horizontal ducts and provided with cool air discharge holes formed therethrough for discharging cool air.

In accordance with yet another aspect of the present invention, there is provided a cool air supply duct of a refrigerator comprising: cool air discharge holes for discharging cool air to at least one of a freezing chamber and a refrigerating chamber of the refrigerator; and a duct unit, the length of which is adjusted at least in one direction of vertical, horizontal, and anteroposterior directions so that the positions of the cool air discharge holes can be moved.

The duct unit may comprise a vertical duct unit disposed in the vertical direction in the freezing chamber or the refrigerating chamber so that the length of the vertical duct unit can be adjusted in the vertical direction.

The duct unit may comprise a horizontal duct unit disposed in the horizontal direction in the freezing chamber or the refrigerating chamber so that the length of the horizontal duct unit can be adjusted in the horizontal direction.

The duct unit may comprise an anteroposterior duct unit disposed in the anteroposterior direction in the freezing chamber or the refrigerating chamber so that the length of the anteroposterior duct unit can be adjusted in the anteroposterior direction.

The duct unit may comprise a horizontal duct unit disposed in the horizontal direction in the freezing chamber or the refrigerating chamber so that the length of the horizontal duct unit can be adjusted in the horizontal direction; and vertical duct units disposed on the horizontal duct unit so that the length of each of the vertical duct units can be adjusted in the vertical direction.

The duct unit may comprise a vertical duct unit disposed in the vertical direction in the freezing chamber or the refrigerating chamber so that the length of the vertical duct unit can be adjusted in the vertical direction; horizontal duct units disposed on the vertical duct unit so that the length of each of the horizontal duct units can be adjusted in the horizontal direction; and anteroposterior duct units respectively disposed on the horizontal duct units so that the length of each of the anteroposterior duct units can be adjusted in the anteroposterior direction and provided with the cool air discharge holes formed therethrough.

Since the length of a duct unit provided with cool air discharge holes formed at a designated position thereof is adjustable, the cool air discharge holes can be moved to positions desired by a user by increasing or decreasing the length of the duct unit. Thereby, the cool air supply duct of the present invention can cool a designated space of a freezing chamber or a refrigerating chamber of the refrigerator to a temperature lower or higher than those of other spaces, thus increasing convenience in using the cool air supply duct and improving the cooling efficiency of the cool air supply duct.

When racks or food are located at positions closing the cool air discharge holes, the cool air discharge holes are moved to other positions by increasing or decreasing the length of the duct unit. Thereby, the cool air supply duct prevents food located at a designated space from rotting caused by the closing of the cool air discharge holes.

The cool air supply duct of the present invention is installed in the freezing chamber or the refrigerating chamber of the refrigerator, thus minimizing an adiabatic loss of the refrigerator.

Since the cool air discharge holes of the cool air discharge duct of the present invention are moved in the vertical and horizontal directions with two-dimensional freedom, the positions of the cool air discharge holes are arbitrarily changed.

Further, since the cool air discharge holes of the cool air discharge duct of the present invention are moved in the anteroposterior direction as well as in the vertical and horizontal directions with three-dimensional freedom, when the anteroposterior width of the freezing chamber or the refrigerating chamber is large, food is placed in the front portion of the freezing chamber or the refrigerating chamber and the cool air discharge holes are moved to the front portion of the freezing chamber or the refrigerating chamber. Thereby, the cool air supply duct of the present invention effectively freezes/refrigerates the food and does not require a user to insert the food deeply to the rear portion of the freezing chamber or the refrigerating chamber.

Since one of a plurality of ducts of the duct unit is slidably inserted into another of a plurality of the ducts, the movement range of the air discharge holes is wide.

Since the length of at least one of a plurality of duct units is adjustable by user's instructions or according to the temperature of a designated space of the freezing chamber or the refrigerating chamber, the cool air supply duct of the present invention is conveniently used.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
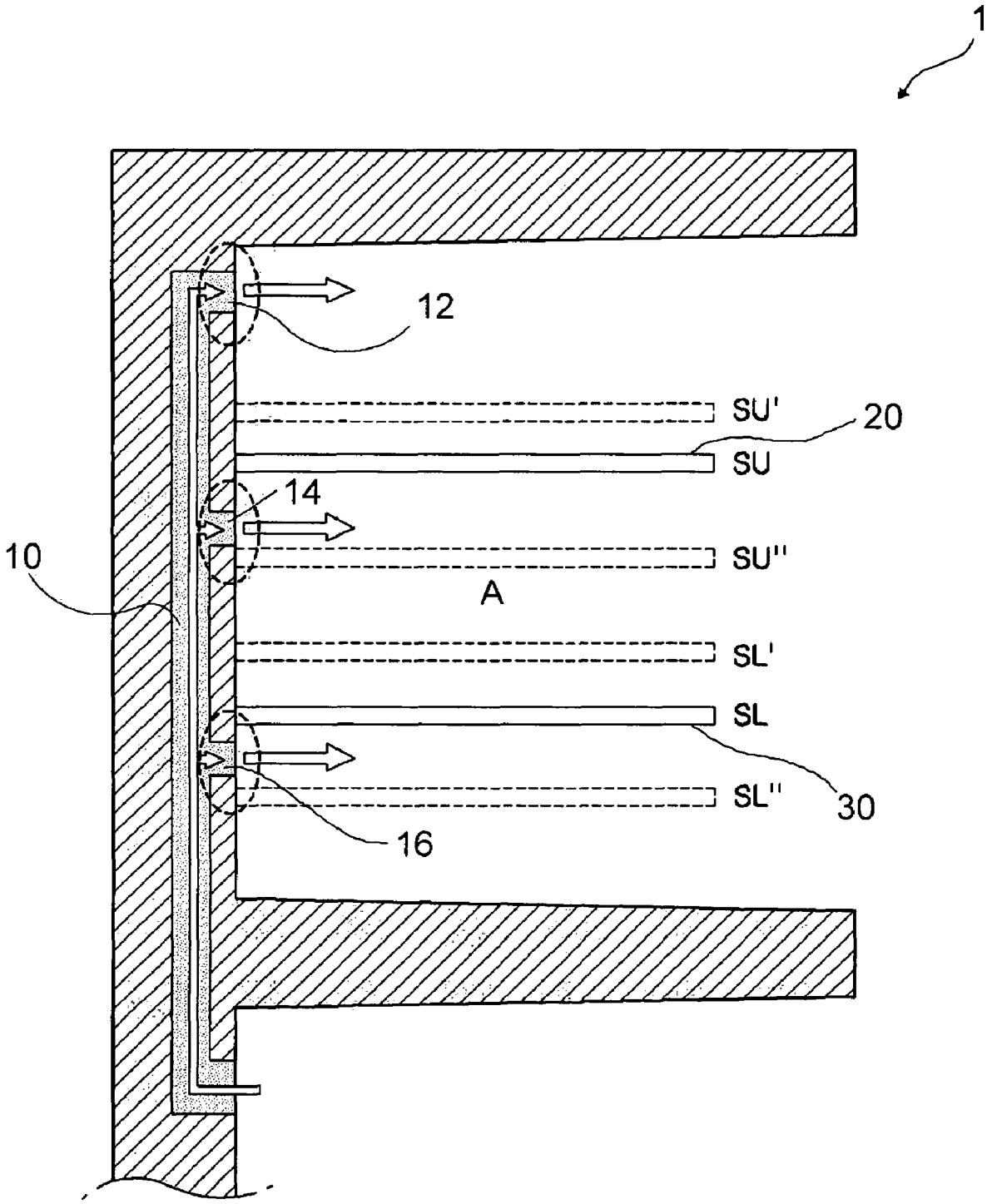
FIG. 1 (related art)
FIG. 1 is a schematic sectional view of a conventional cool air supply duct of a refrigerator.
Figure 2:
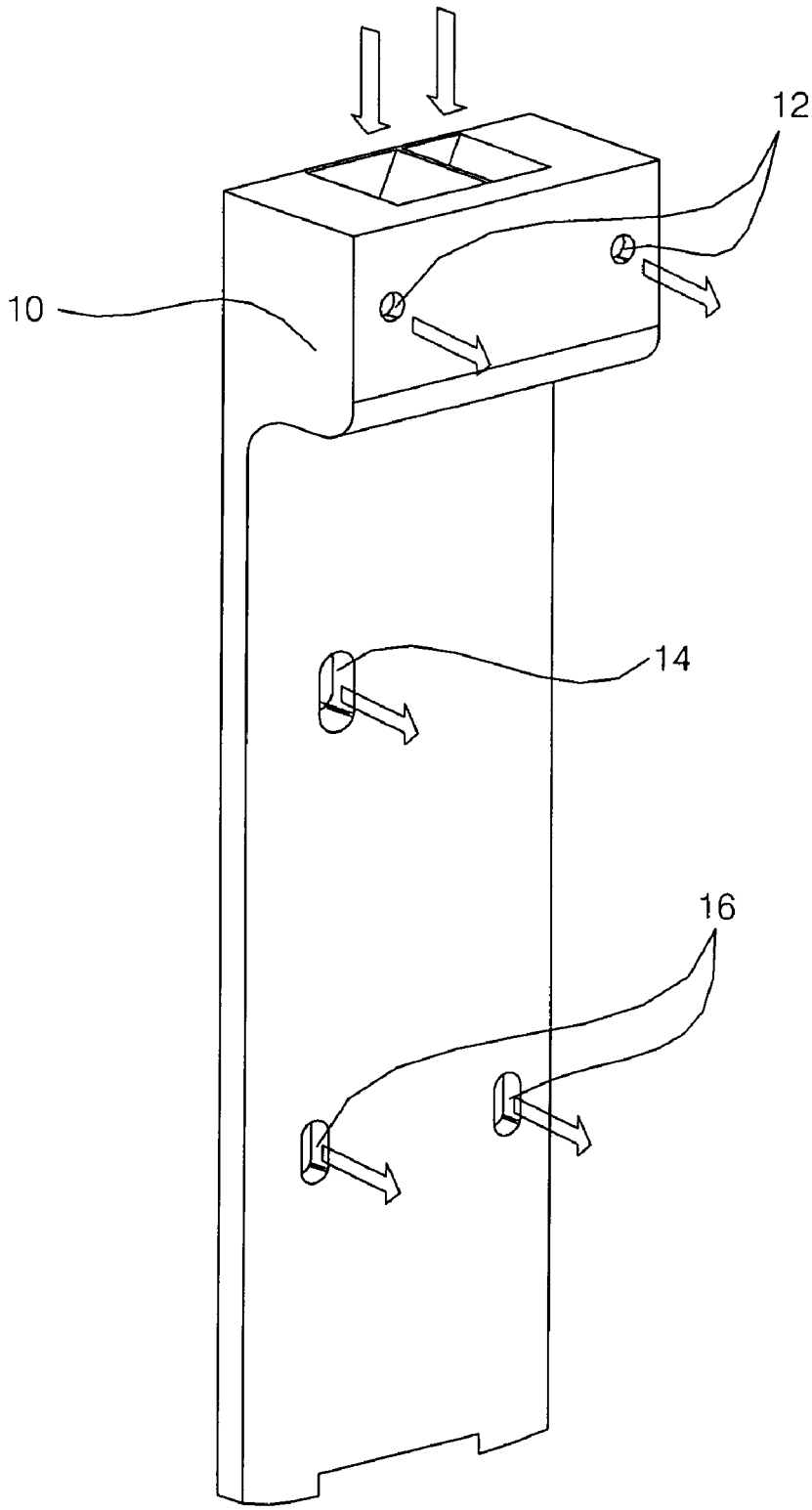
FIG. 2 (related art)
FIG. 2 is a perspective view of the conventional cool air supply duct of the refrigerator.
Figure 3:
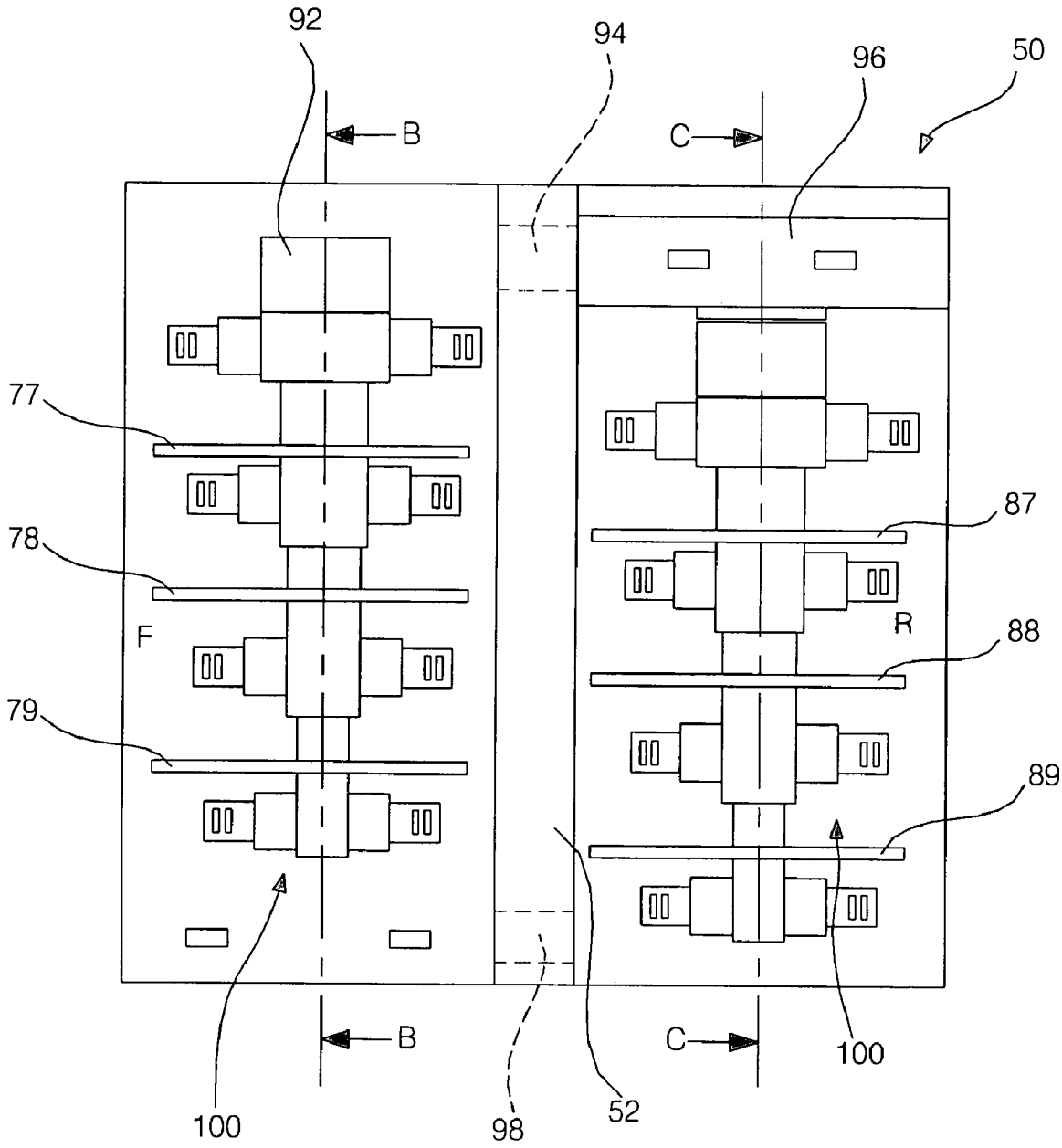
FIG. 3 is a schematic front view of a refrigerator employing a cool air supply duct in accordance with a first embodiment of the present invention.
Figure 4:
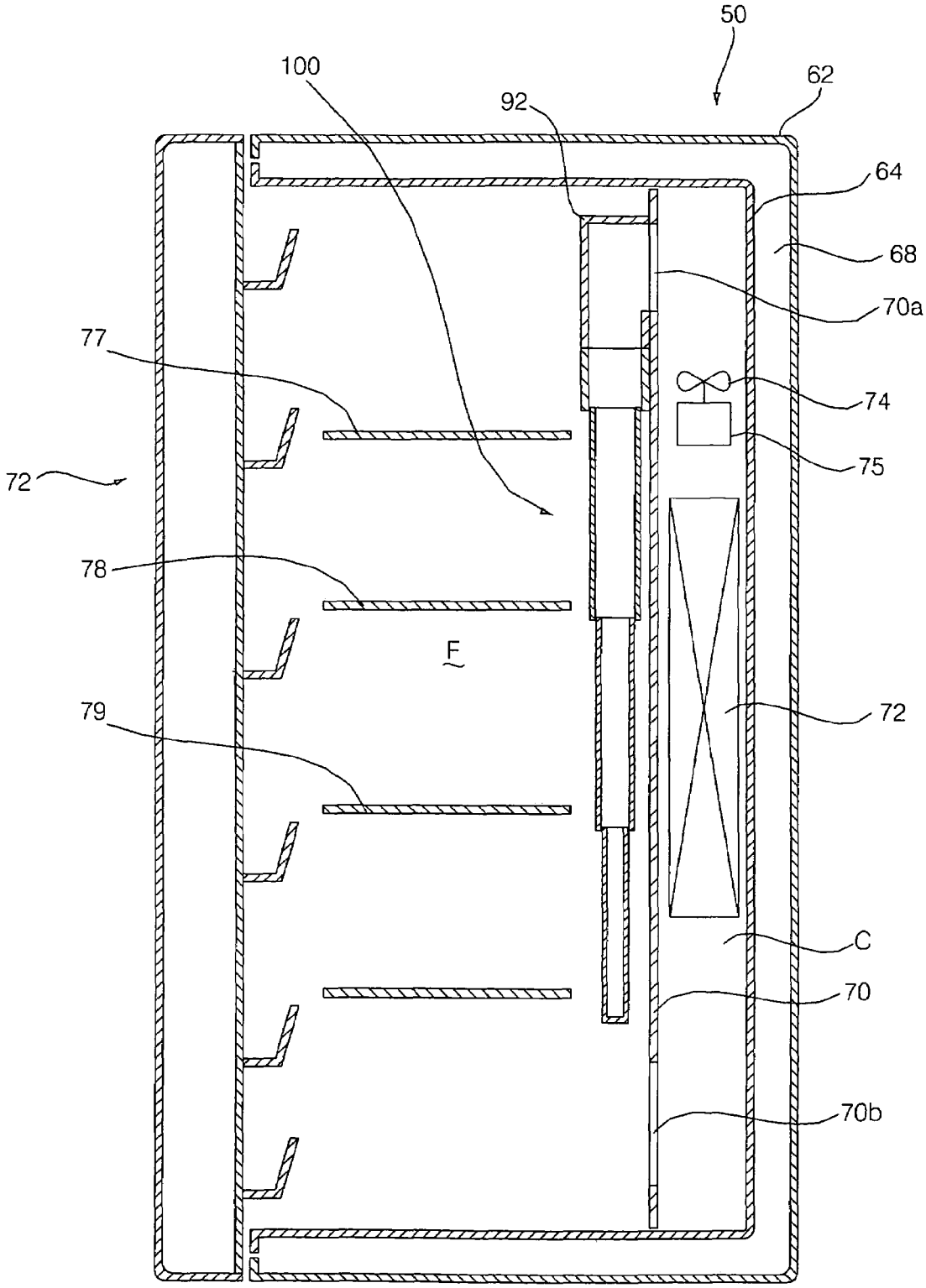
FIG. 4 is a sectional view taken along the line B-B of FIG. 3.
Figure 5:
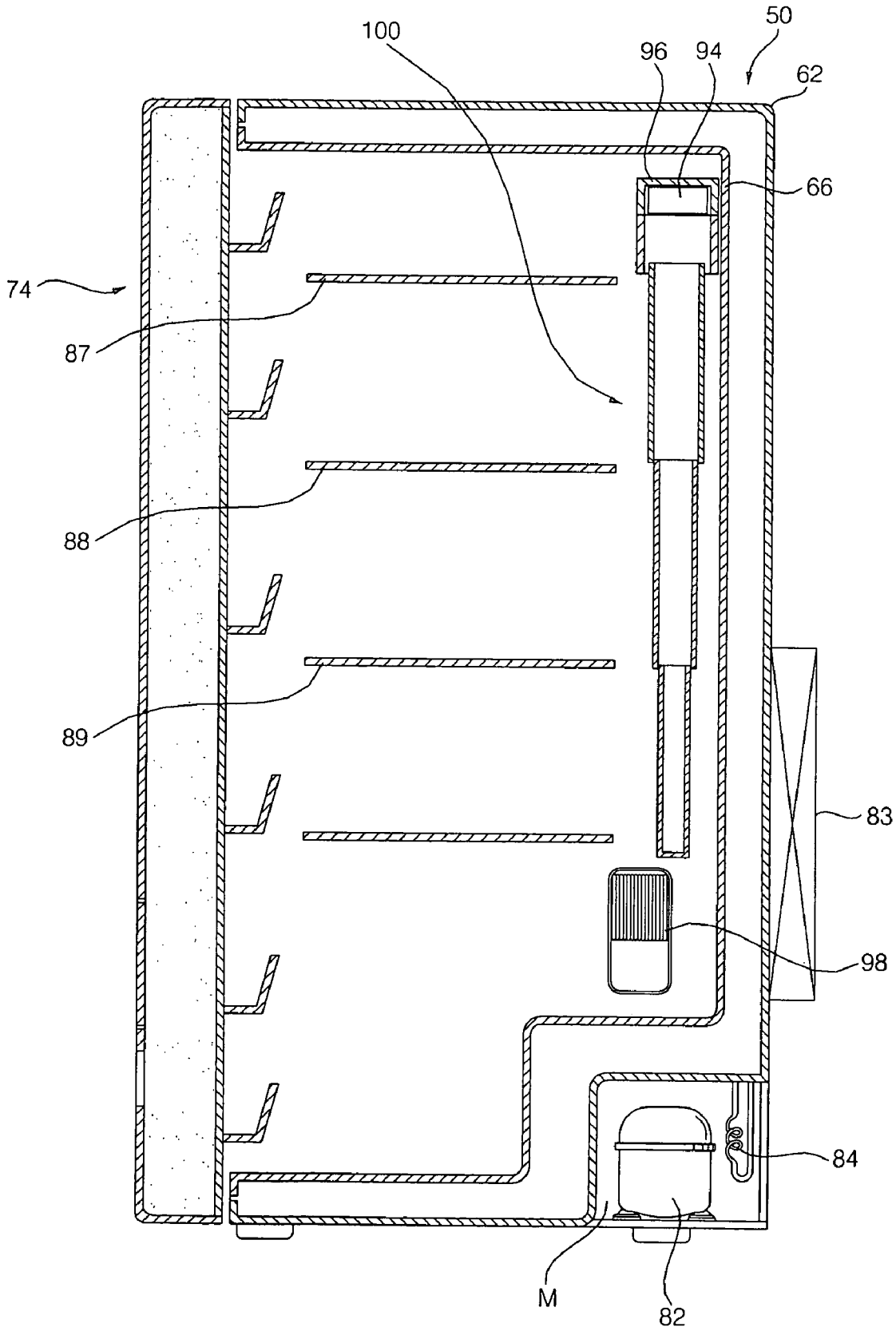
FIG. 5 is a sectional view taken along the line C-C of FIG. 3.

FIG. 3 is a schematic front view of a refrigerator employing a cool air supply duct in accordance with a first embodiment of the present invention, FIG. 4 is a sectional view taken along the line B-B of FIG. 3, and FIG. 5 is a sectional view taken along the line C-C of FIG. 3.

The refrigerator as shown in FIG. 3 comprises a main body 50 having a freezing chamber (F) and a refrigerating chamber (R), which are horizontally divided by a barrier 52.

As shown in FIGS. 4 and 5, the main body 50 comprises an outer casing 62 defining the external appearance of the main body 50, a freezing chamber inner casing 64 located in the outer casing 62 for forming the freezing chamber (F) and provided with a front surface opened to put or take objects to be frozen into or out of the freezing chamber (F), a refrigerating chamber inner casing 66 located in the outer casing 62 for forming the refrigerating chamber (R) and provided with a front surface opened to put or take objects to be refrigerated into or out of the refrigerating chamber (R), and a heat insulator 68 filling a space between the outer surface of the freezing chamber inner casing 64 and the inner surface of the outer casing 62 and a space between the outer surface of the refrigerating chamber inner casing 66 and the inner surface of the outer casing 62.

As shown in FIG. 4, a cooling chamber (C) is formed on the rear surface of the freezing chamber inner casing 64, and a cooling chamber panel 70, through which a cooling air discharge hole 70*a* and a cooling air return hole 70*b* are formed through, is disposed in the freezing chamber inner casing 64.

An evaporator 72 for evaporating a refrigerant in a low-temperature and low-pressure state, a cooling fan 74 for circulating air, having exchanged heat with the evaporator 72, into the freezing chamber (F) and the refrigerating chamber (R), and a motor 75 for rotating the cooling fan 74 are installed in the cooling chamber (C).

A freezing chamber door 76 for opening and closing the freezing chamber (F) is rotatably connected to the front surface of the main body 50.

A plurality of freezing chamber racks 77, 78, and 79, which are separated from each other in the vertical direction, are installed in the freezing chamber (F) so that the heights of the freezing chamber racks 77, 78, and 79 are adjustable.

As shown in FIG. 5, a machinery chamber (M) is installed at a designated position of the lower portion of the main body 50.

The main body 50 further comprises a compressor 82 installed in the machinery chamber (M) for compressing the refrigerant in a low-temperature and low-pressure gaseous state evaporated by the evaporator 72, a condenser 83 installed in the machinery chamber (M) or on the rear surface of the outer casing 62 for condensing the refrigerant by radiating heat of the refrigerant in a high-pressure state compressed by the compressor 82 to external air, and an expansion device 84 for decompressing the refrigerant condensed by the condenser 83 so that the refrigerant can be easily evaporated.

A refrigerating chamber door 86 for opening and closing the refrigerating chamber (R) is rotatably connected to the front surface of the main body 50.

A plurality of refrigerating chamber racks 87, 88, and 89, which are separated from each other in the vertical direction, are installed in the refrigerating chamber (R) so that the heights of the refrigerating chamber racks 87, 88, and 89 are adjustable.

As shown in FIGS. 3 to 5, a cool air supply duct 100, in which positions of cool air discharge holes are changeable, is installed at least one of the freezing chamber (F) and the refrigerating chamber (R).

The length of the cool air supply duct 100 is adjusted so that the positions of the cool air discharge holes are changeable. The cool air supply duct 100 may be installed only in the freezing chamber (F) or in the refrigerating chamber (R), or may be installed both in the freezing chamber (F) and the refrigerating chamber (R).

Here, reference numeral 92 shown in FIGS. 3 and 4 represents a freezing chamber connection duct for guiding the cool air having passed through the cool air discharge hole 70*a* to the cool air supply duct 100 installed in the freezing chamber (F).

Reference numeral 94 shown in FIGS. 3 and 4 represents a cool air guide duct installed in the upper portion of the barrier 52 such that its one end is communicated with the refrigerating chamber (R) and its the other end is communicated with the cooling chamber (C). Thereby, the air cooled by the evaporator 72 is supplied to the refrigerating chamber (R).

Reference numeral 96 shown in FIGS. 3 and 5 represents a refrigerating chamber connection duct for guiding the air having passed through the cool air guide duct 94 to the cool air supply duct 100 installed in the refrigerating chamber (R).

Reference numeral 98 shown in FIGS. 3 and 5 represents a cool air return duct installed in the lower portion of the barrier 52 such that its one end is communicated with the refrigerating chamber (R) and its the other end is communicated with the cooling chamber (C). Thereby, the air having cooled the refrigerating chamber (R) is returned to the cooling chamber (C).

Figure 6:
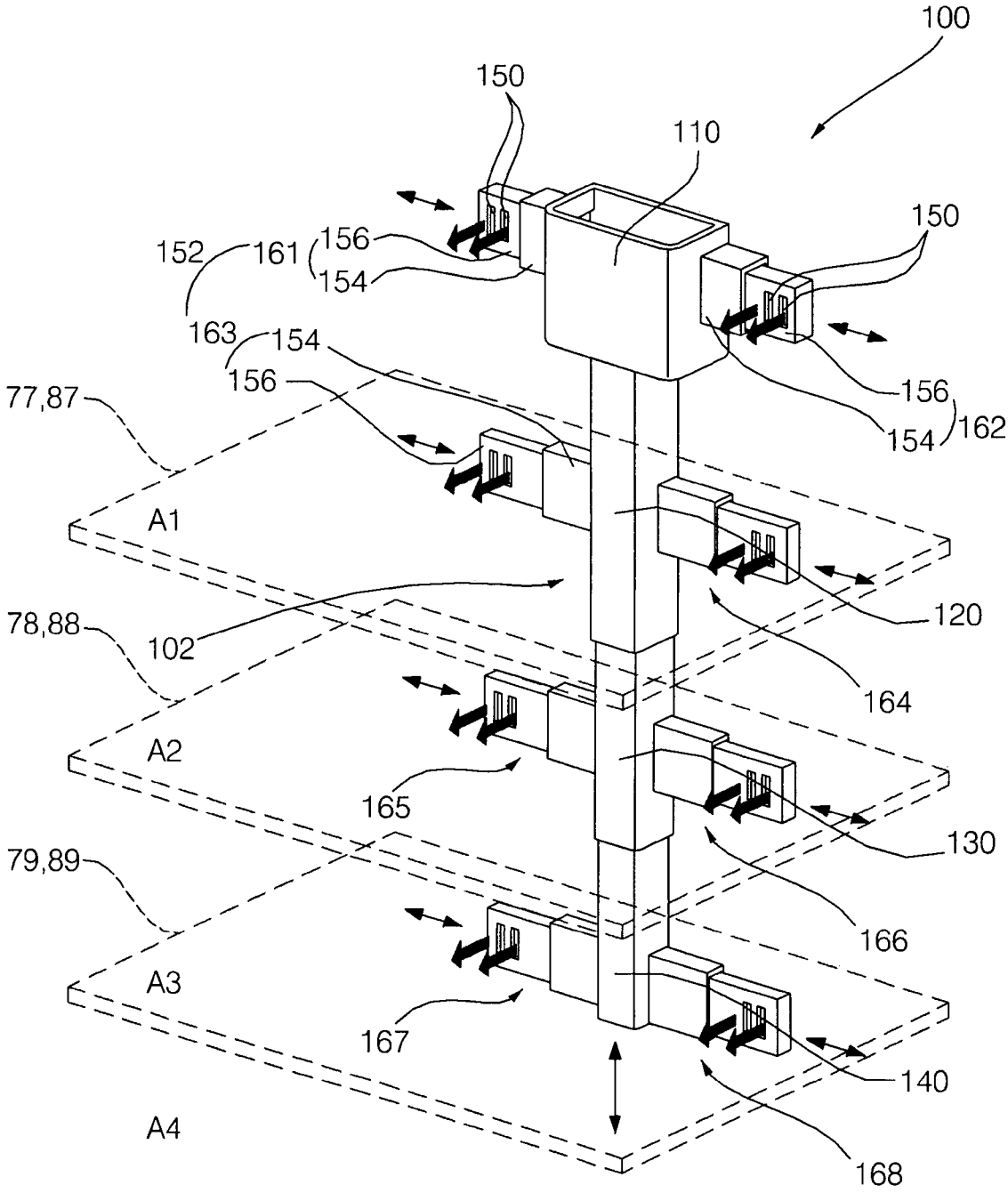
FIG. 6 is a perspective view of the cool air supply duct in accordance with the first embodiment of the present invention.
Figure 7:
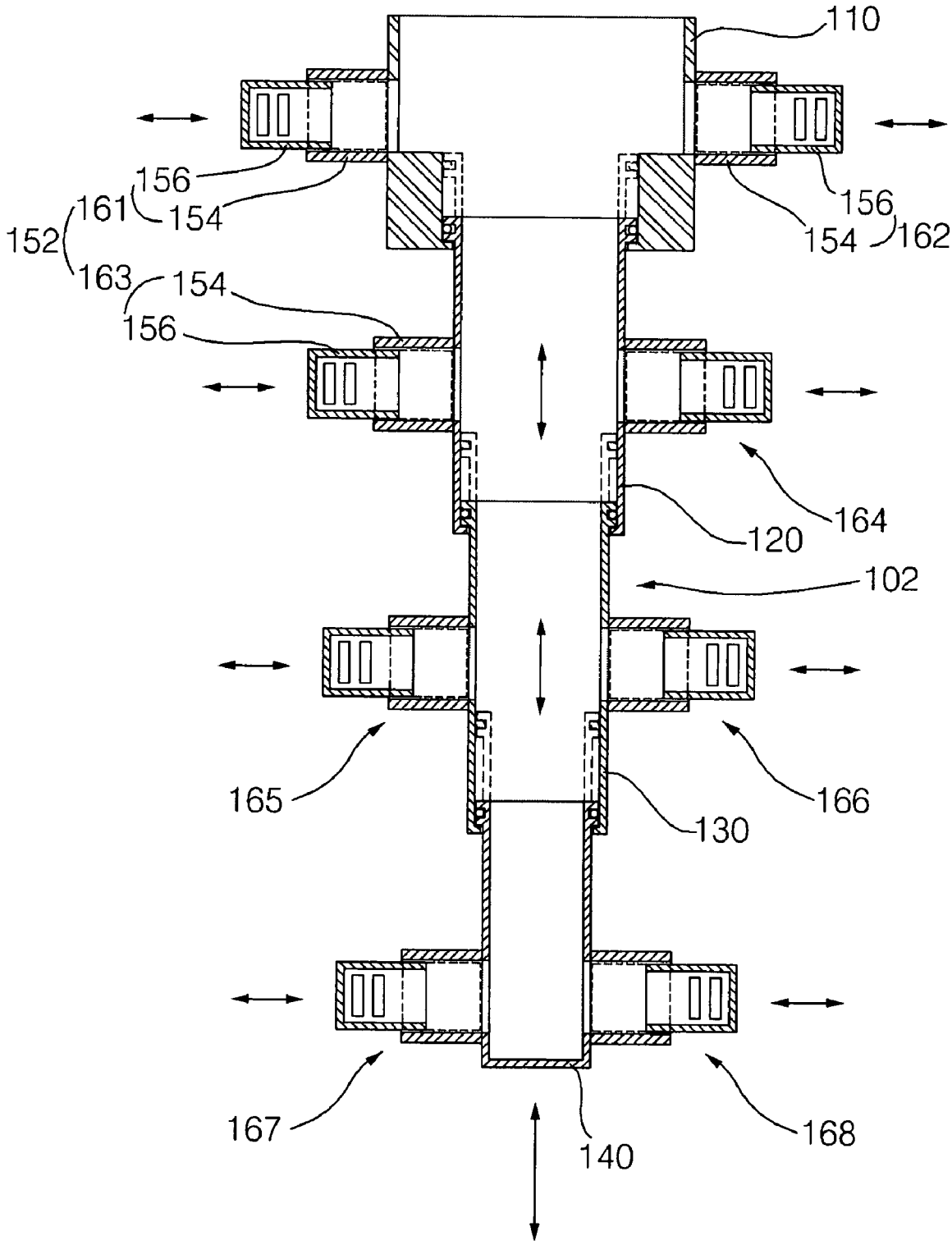
FIG. 7 is a sectional view of the cool air supply duct in accordance with the first embodiment of the present invention.

FIG. 6 is a perspective view of the cool air supply duct in accordance with the first embodiment of the present invention, and FIG. 7 is a sectional view of the cool air supply duct in accordance with the first embodiment of the present invention.

As shown in FIGS. 6 and 7, the cool air supply duct 100 comprises a vertical duct unit 102 installed in the freezing chamber (F) or the refrigerating chamber (R) so that the length of the vertical duct unit 102 is adjusted in the vertical direction, and horizontal duct units 152 installed on the vertical duct unit 102 so that the length of each of the horizontal duct units 152 is adjusted in the horizontal direction and provided with cool air discharge holes 150 formed therethrough.

The vertical duct unit 102 has a plurality of vertical ducts 110, 120, 130, and 140, at least one of which slides in the vertical direction.

The vertical ducts 110, 120, 130, and 140 are divided into one stationary vertical duct 110 fixedly installed in the freezing chamber (F) or the refrigerating chamber (R), and movable vertical ducts 120, 130 and 140, at least one of which is slidably disposed on the stationary vertical duct 110 in the vertical direction.

Preferably, the vertical ducts 110, 120, 130, and 140 have a hexahedral shape having a hollow formed therethrough in the vertical direction or a cylindrical shape having a hollow formed therethrough in the vertical direction. More preferably, the stationary vertical duct 110 has a hexahedral shape so that the stationary vertical duct 110 can be fixedly installed in the freezing chamber (F) or the refrigerating chamber (R), and the movable vertical ducts 120, 130 and 140 have a hexahedral shape so that the arbitrary rotation of the movable vertical ducts 120, 130 and 140 are limited.

The stationary vertical duct 110 may be suspended on the freezing inner casing 64 or the refrigerating inner casing 66 using a hook formed through the stationary vertical duct 110 and a hole formed through the freezing inner casing 64 or the refrigerating inner casing 66, be connected to the freezing inner casing 64 or the refrigerating inner casing 66 using a connection member, such as a screw, or be attached to the freezing inner casing 64 or the refrigerating inner casing 66 using an adhesive, such as a bond, or by thermal fusion.

The stationary vertical duct 110 is larger than the movable vertical ducts 120, 130 and 140 so that the movable vertical ducts 120, 130 and 140 are partially inserted into the stationary vertical duct 110.

The movable vertical ducts 120, 130 and 140 are configured such that they are slidably inserted into each other in the vertical direction.

Hereinafter, the movable vertical ducts 120, 130 and 140 are divided into a first movable vertical duct 120 partially inserted into the stationary vertical duct 110, a second movable vertical duct 130 partially inserted into the first movable vertical duct 120, and a third movable vertical duct 140 partially inserted into the second movable vertical duct 130.

Preferably, the movable vertical ducts 120, 130 and 140 have different sizes so that one of the movable vertical ducts 120, 130 and 140 is partially inserted into another of the movable vertical ducts 120, 130 and 140. More preferably, the sizes of the movable vertical ducts 120, 130 and 140 are gradually decreased in the direction of increasing the length of the vertical duct unit 102.

The horizontal duct units 152 are disposed horizontally with at least one of left and right sides of the vertical duct unit 102.

The horizontal duct units 152 may be protruded from one of the left and right sides of the vertical duct unit 102. However, hereinafter, the horizontal duct units 152 are protruded from the left and right sides of the vertical duct unit 102 so that the horizontal duct units 152 can blow cool air to the left and right front portion of the vertical duct unit 102.

The horizontal duct units 152 may be protruded from at least one of the plural vertical ducts 110, 120, 130 and 140 of the vertical duct unit 102. However, hereinafter, the horizontal duct units 152 are protruded from all the plural vertical ducts 110, 120, 130 and 140 and separated from each other in the vertical direction so that the horizontal duct units 152 can three-dimensionally blow cool air.

Each of the horizontal duct units 152 has a stationary horizontal duct 154 communicated with the inside of the vertical duct unit 102 and protruded from the vertical duct unit 102, and a movable horizontal duct 156 slidably inserted into the stationary horizontal duct 154 and provided with cool air discharge holes 150 formed therethrough.

Preferably, the stationary horizontal duct 154 has a hexahedral shape having a hollow formed therethrough in the horizontal direction or a cylindrical shape having a hollow formed therethrough in the horizontal direction.

The stationary horizontal ducts 154 may be formed separately from the corresponding vertical ducts 110, 120, 130 and 140 of the vertical duct unit 102 and connected to the vertical ducts 110, 120, 130 and 140 by connection members, such as hooks or screws, an adhesive, such as a bond, or by thermal fusion, or be formed integrally with the vertical ducts 110, 120, 130 and 140 when the vertical ducts 110, 120, 130 and 140 are molded.

The stationary horizontal ducts 154 are larger than the movable horizontal ducts 156 so that the movable horizontal ducts 156 are completely or partially inserted into the stationary horizontal ducts 156.

The cool air discharge holes 150 are formed through the movable horizontal ducts 156 at designated positions so that the cool air discharge holes 150 are closed by the stationary horizontal duct 154 when the movable horizontal ducts 156 are slidably inserted into the stationary horizontal ducts 154 in the horizontal direction.

Hereinafter, the horizontal duct units 152 are divided into first left and right horizontal duct units 161 and 162 protruded from the left and right sides of the stationary vertical duct 110, second left and right horizontal duct units 163 and 164 protruded from the left and right sides of the first movable vertical duct 120, third left and right horizontal duct units 165 and 166 protruded from the left and right sides of the second movable vertical duct 130, and fourth left and right horizontal duct units 167 and 168 protruded from the left and right sides of the third movable vertical duct 140.

Now, the operation of the cool air supply duct 100 of the refrigerator in accordance with the present invention will be described in detail.

First, as shown in FIG. 6, the first, second, third movable vertical ducts 120, 130 and 140 slidably move in the vertical direction, and the heights of the first, second, third movable vertical ducts 120, 130 and 140 are adjusted so that the first left and right horizontal duct units 161 and 162 face a space above the upper racks 77 and 87 (hereinafter, referred to as "A1"), the second left and right horizontal duct units 163 and 164 face a space between the upper racks 77 and 87 and the central racks 78 and 88 (hereinafter, referred to as "A2"), the third left and right horizontal duct units 165 and 166 face a space between the central racks 78 and 88 and the lower racks 79 and 89 (hereinafter, referred to as "A3"), and the fourth left and right horizontal duct units 167 and 168 face a space below the lower racks 79 and 89 (hereinafter, referred to as "A4").

Thereafter, the movable horizontal ducts 156 of the first, second, third, and fourth left horizontal duct units 161, 163, 165 and 167 slidably move to the left, and the movable horizontal ducts 156 of the first, second, third, and fourth right horizontal duct units 162, 164, 166 and 168 slidably move to the right, thereby opening the cool air discharge holes 150 of the horizontal duct units 152.

Under the condition that the cool air supply duct 100 of the present invention is disposed as described above, the cool air, introduced into the stationary vertical duct 110, is dispersed downwardly or sidewardly, and is then uniformly discharged to the spaces A1, A2, A3 and A4 through the cool air discharge holes 150 of the horizontal duct units 152.

Figure 8:
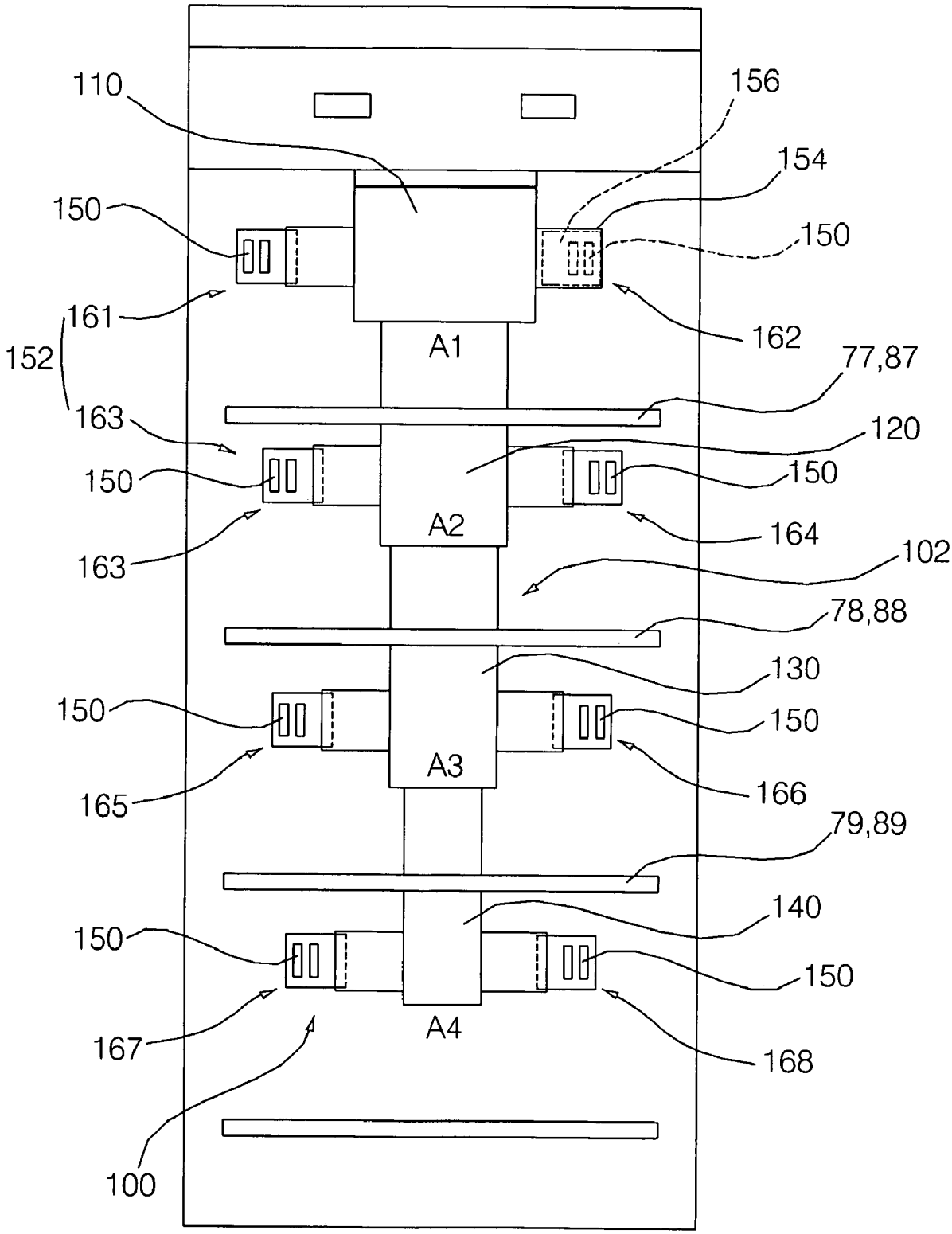
FIG. 8 is a schematic front view of the cool air supply duct in accordance with the first embodiment of the present invention when the duct does not discharge cool air to a designated space of a freezing chamber or a refrigerating chamber.

FIG. 8 is a schematic front view of the cool air supply duct in accordance with the first embodiment of the present invention when the duct does not discharge cool air to a designated space of the freezing chamber or the refrigerating chamber.

As shown in FIG. 8, when the movable horizontal duct 156 of the first right horizontal duct unit 162 slides to the left and is inserted into the stationary horizontal duct 154 of the first right horizontal duct unit 162, the cool air discharge holes 150 of the movable horizontal duct 156 of the first right horizontal duct unit 162 are closed by the stationary horizontal duct 154 of the first right horizontal duct unit 162.

The cool air in the cool air supply duct 100 is not discharged from the cool air discharge holes 150 of the first right horizontal duct unit 162, but is discharged from the cool air discharge holes 150 of other horizontal duct units 161, 163, 164, 165, 166, 167 and 168.

Figure 9:
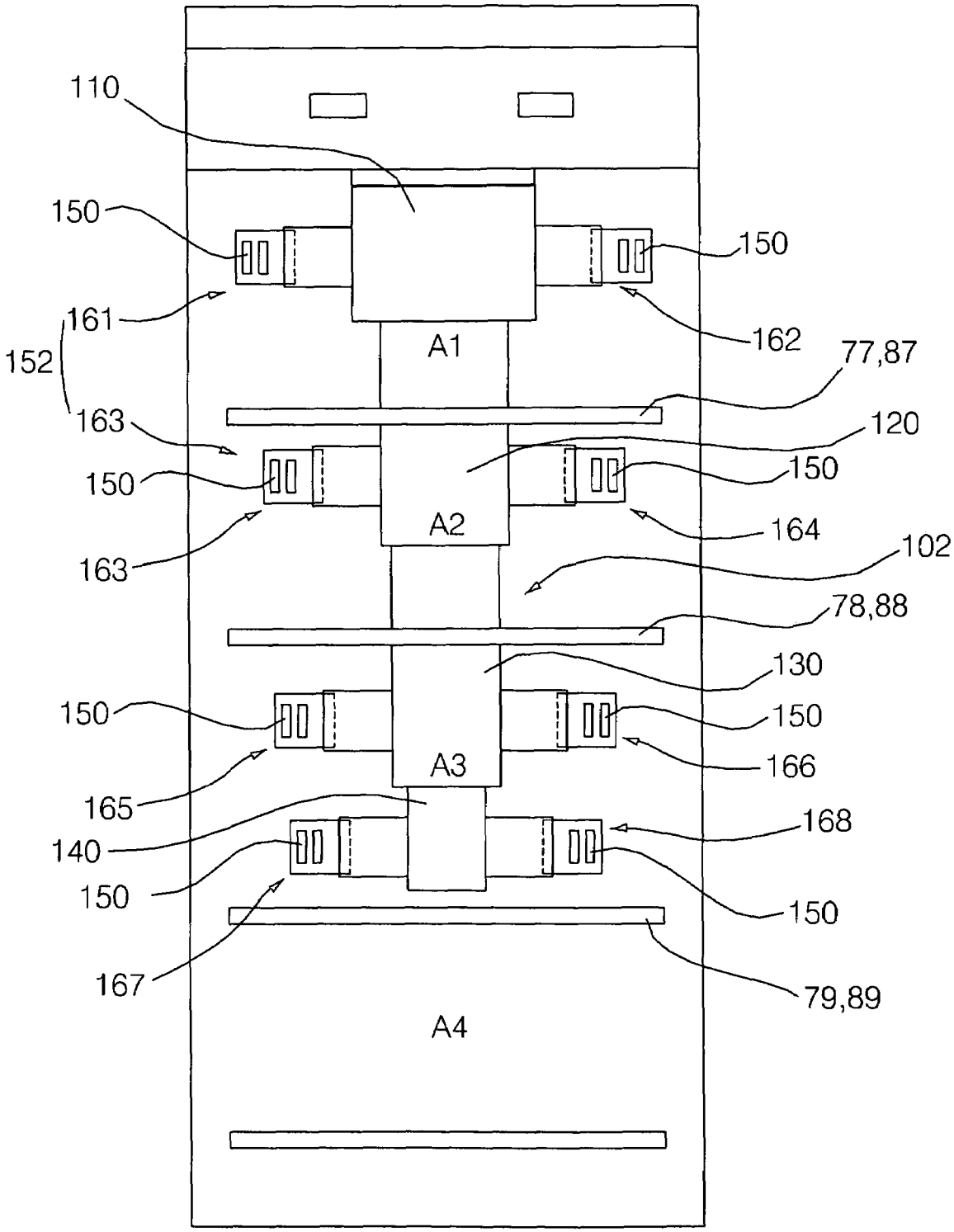
FIG. 9 is a schematic front view of the cool air supply duct in accordance with the first embodiment of the present invention when the duct discharges cool air is concentrated on a designated space of the freezing chamber or the refrigerating chamber.

FIG. 9 is a schematic front view of the cool air supply duct in accordance with the first embodiment of the present invention when the duct discharges cool air to a designated space of the freezing chamber or the refrigerating chamber.

As shown in FIG. 9, when the third movable vertical duct 140 slides upwardly to a designated height so that the fourth left and right horizontal duct units 167 and 168 face the space A3 together with the third left and right horizontal duct units 165 and 166, under the condition that the third left and right horizontal duct units 165 and 166 maintain their height or are elevated to a designated height so that the third left and right horizontal duct units 165 and 166 face the space A3, a small amount of the cool air in the cool air supply duct 100 is discharged to the spaces A1 and A2, and a large amount of the cool air in the cool air supply duct 100 is discharged to the space A3. Further, the cool air in the cool air supply duct 100 is not discharged to the space A4.

Figure 10:
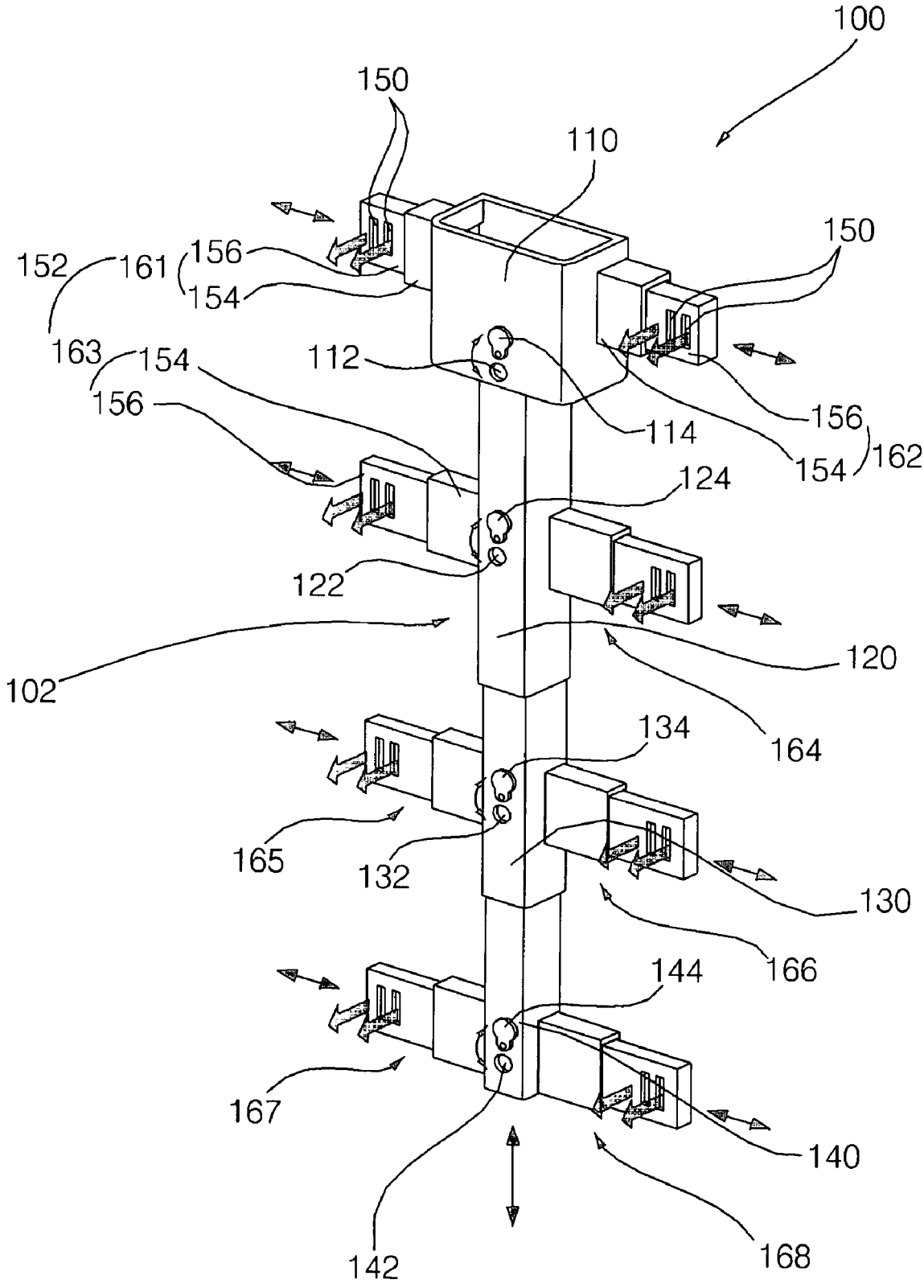
FIG. 10 is a perspective view of a cool air supply duct of a refrigerator in accordance with a second embodiment of the present invention.

FIG. 10 is a perspective view of a cool air supply duct of a refrigerator in accordance with a second embodiment of the present invention.

The cool air supply duct 100 in accordance with this embodiment further comprises second cool air discharge holes 112, 122, 132 and 142 formed through at least one of the plural vertical ducts 110, 120, 130 and 140 of the vertical duct unit 102.

Most preferably, the second cool air discharge holes 112, 122, 132 and 142 are respectively formed through the plural vertical ducts 110, 120, 130 and 140.

The cool air supply duct 10 in accordance with this embodiment further comprise opening and closing members 114, 124, 134 and 144 for opening and closing the second cool air discharge holes 112, 122, 132 and 142.

The opening and closing members 114, 124, 134 and 144 may be rotary stoppers, which are installed with a center of rotation around the second cool air discharge holes 112, 122, 132 and 142 and are rotated towards the second cool air discharge holes 112, 122, 132 and 142 for opening and closing the second cool air discharge holes 112, 122, 132 and 142, as shown in FIG. 10, be slidable stoppers, which are installed around the second cool air discharge holes 112, 122, 132 and 142 and are slid towards the second cool air discharge holes 112, 122, 132 and 142 for opening and closing the second cool air discharge holes 112, 122, 132 and 142, or be detachable stoppers, which are inserted from the front of the second cool air discharge holes 112, 122, 132 and 142 into the second cool air discharge holes 112, 122, 132 and 142.

The configuration and function of the cool air supply duct 100 of this embodiment except for the second cool air discharge holes 112, 122, 132 and 142 and the opening and closing members 114, 124, 134 and 144, which are substantially the same as those of the first embodiment, are denoted by the same reference numerals even though they are depicted in different drawings and a detailed description thereof will thus be omitted because it is considered to be unnecessary.

Figure 11:
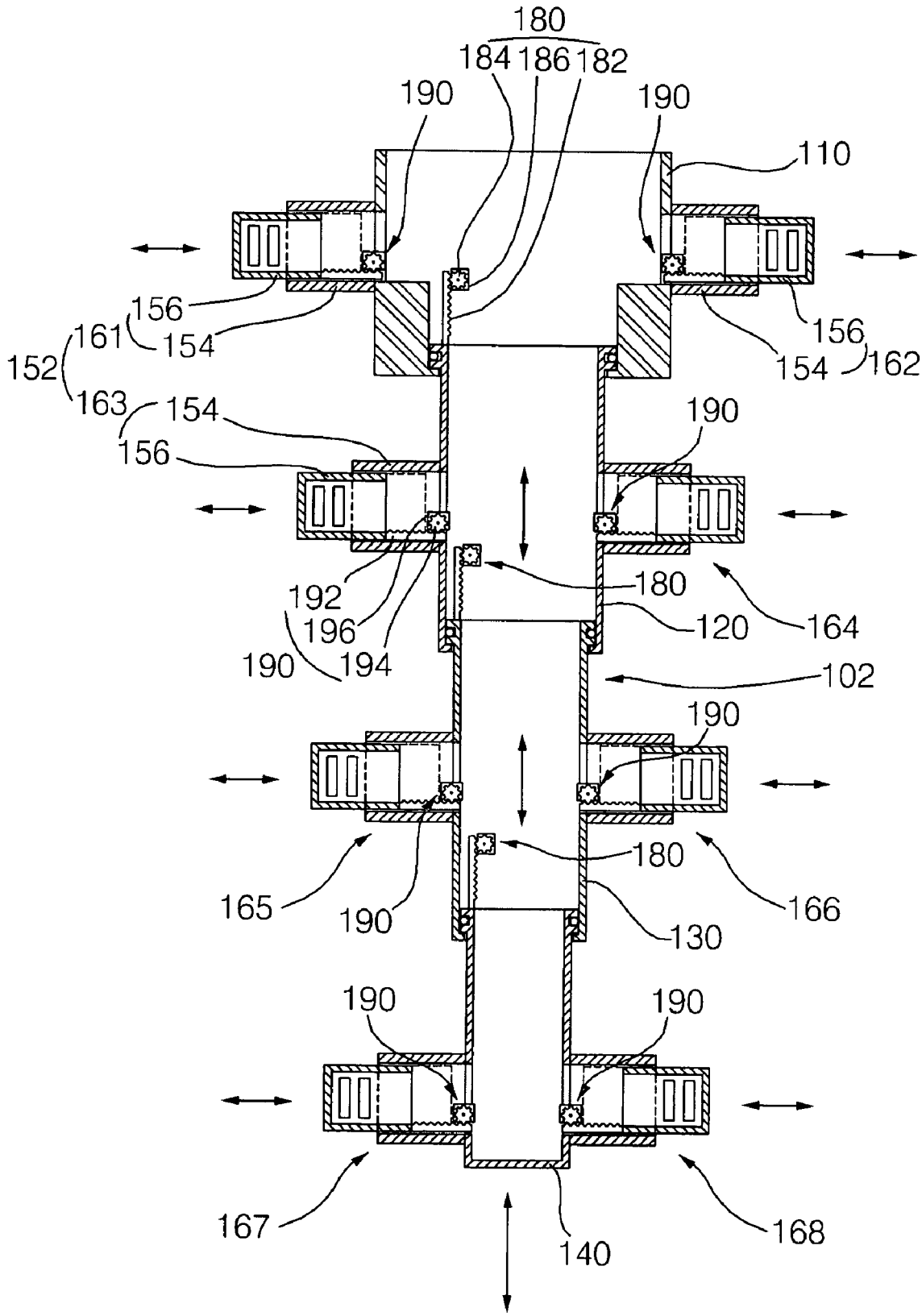
FIG. 11 is a sectional view of a cool air supply duct of a refrigerator in accordance with a third embodiment of the present invention.

FIG. 11 is a sectional view of a cool air supply duct of a refrigerator in accordance with a third embodiment of the present invention.

As shown in FIG. 11, the cool air supply duct 100 in accordance with this embodiment further comprises elevating units 180 for elevating at least one of the movable vertical ducts 120, 130 and 140, and reciprocators 190 for sliding the movable horizontal ducts 156 in the horizontal direction.

Here, each of the elevating units 180 comprises an elevating rack 182 formed on the corresponding one of the movable vertical ducts 120, 130 and 140, an elevating pinion 184 engage with the elevating rack 182, and an elevating motor 186 for rotating the elevating pinion 184. The elevating rack 182, the elevating pinion 184, and the elevating motor 186 are installed on each of the movable vertical ducts 120, 130 and 140.

Each of the reciprocators 190 comprises a reciprocating rack 192 formed on the corresponding one of the movable horizontal ducts 156, a reciprocating pinion 194 engaged with the reciprocating rack 192, and a reciprocating motor 196 for rotating the reciprocating pinion 194. The reciprocating rack 192, the reciprocating pinion 194, and the reciprocating motor 196 are installed on each of the movable horizontal ducts 156.

Figure 12:
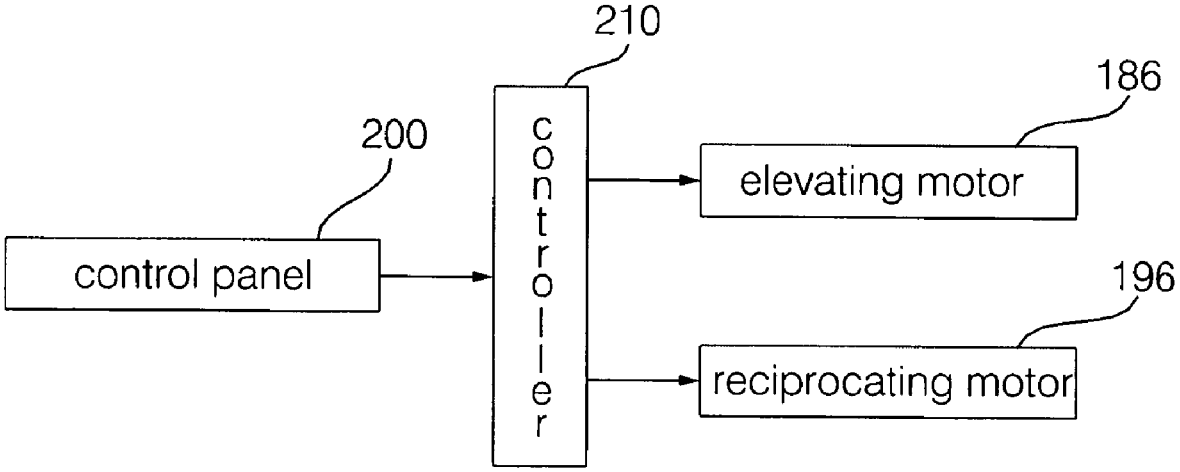
FIG. 12 is a control block diagram of the cool air supply duct in accordance with the third embodiment of the present invention.

FIG. 12 is a control block diagram of the cool air supply duct in accordance with the third embodiment of the present invention.

The cool air supply duct 100 of this embodiment further comprises a control panel 200 for inputting instructions to intensively discharge cool air into a designated space or instructions not to discharge cool air into a designated space by a user, and a controller 210 for controlling at least one of the elevating motors 186 and at least one of the reciprocating motors 196 according to the inputted instructions.

Preferably, the control panel 200 is installed on the front surface of one of the refrigerating chamber door and the freezing chamber door.

Figure 13:
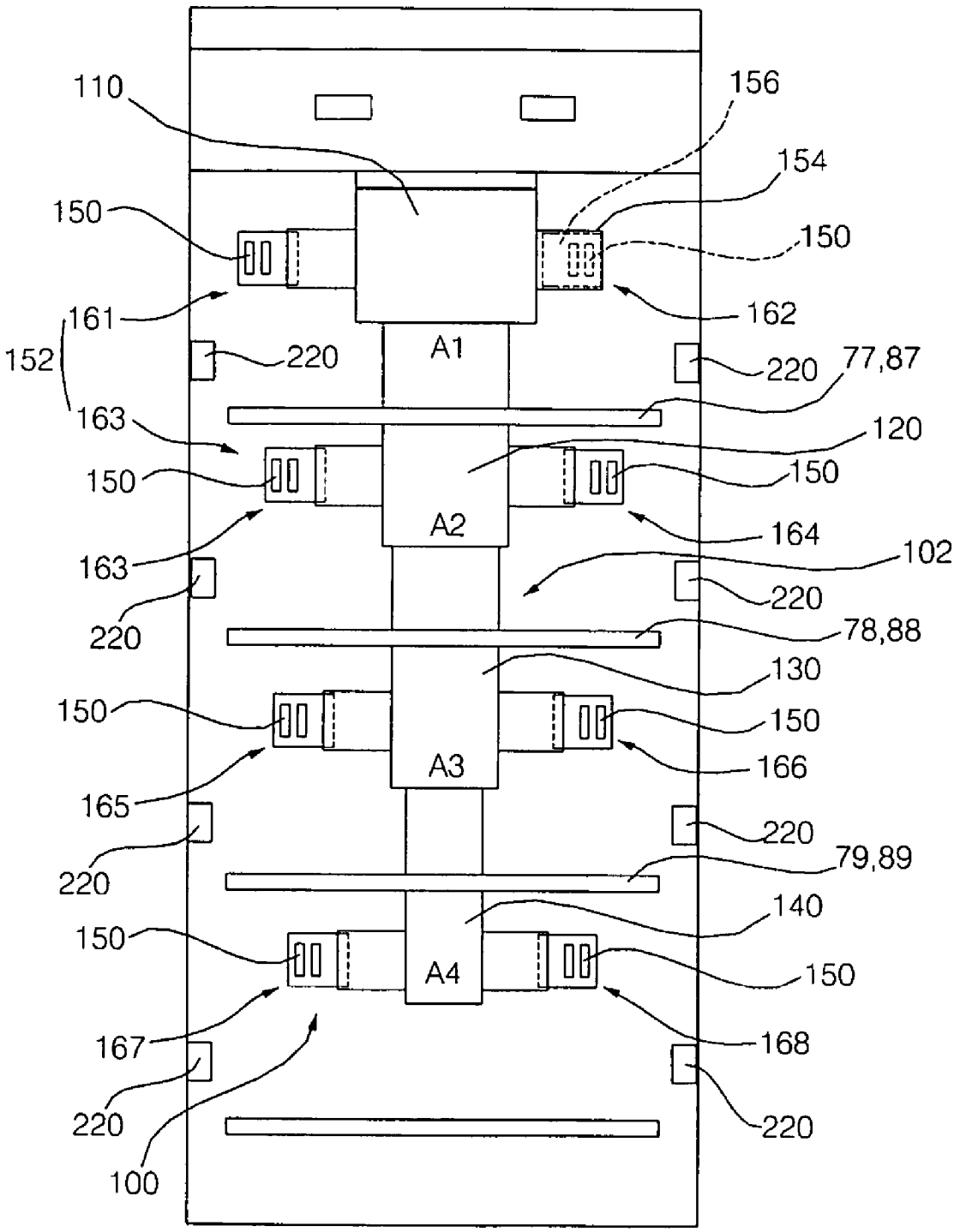
FIG. 13 is a schematic front view of a cool air supply duct of a refrigerator in accordance with a fourth embodiment of the present invention.
Figure 14:
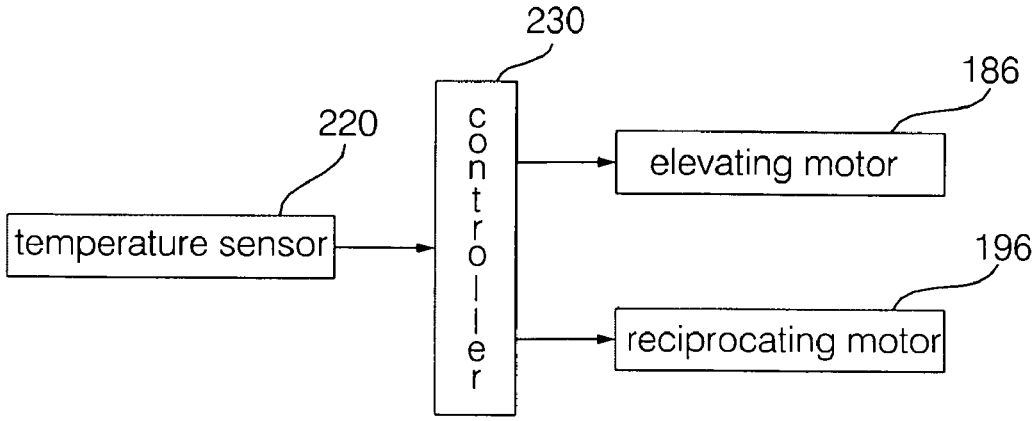
FIG. 14 is a control block diagram of the cool air supply duct in accordance with the fourth embodiment of the present invention.

FIG. 13 is a schematic front view of a cool air supply duct of a refrigerator in accordance with a fourth embodiment of the present invention, and FIG. 14 is a control block diagram of the cool air supply duct in accordance with the fourth embodiment of the present invention.

As shown in FIGS. 13 and 14, the cool air supply duct of this embodiment further comprises temperature sensors 220 for sensing temperatures of the spaces cooled by the respective horizontal ducts 156, and a controller 230 for controlling at least one of the elevating motors 186 and at least one of the reciprocating motors 196 according to the sensed results of the temperature sensors 220.

The temperature sensors 220 are installed at left and right sides of the spaces A1, A2, A3 and A4.

When the temperature sensed by one of the plural temperature sensors 220 exceeds a designated temperature, for example 6° C., the controller 230 determines that the temperature around the temperature sensor 220 having sensed the temperature is elevated, and controls at least one of the elevating motors 186 and at least one of the reciprocating motors 196 so that at least two movable horizontal ducts 156 are gathered around a designated space close to the above temperature sensor 220.

For example, when the temperature sensed by the temperature sensor 220 for sensing the right portion of the space A1 is 6° C., the controller 230 controls the elevating motor 186 elevating the first movable vertical duct 120 in an ascending mode so that the second right horizontal duct unit 164 faces the right portion of the space A1 together with the first right horizontal duct unit 162.

Further, the controller 230 controls the reciprocating motors 196 of the movable horizontal ducts 156 of the first and second right horizontal duct units 162 and 164 in a forward moving mode so that the movable horizontal ducts 156 of the first and second right horizontal duct units 162 and 164 slide to the right.

On the other hand, when the temperature sensed by the temperature sensor 220 for sensing the right portion of the space A1 is 4° C., the controller 230 controls the elevating motor 186 elevating the first movable vertical duct 120 in a descending mode so that the second right horizontal duct unit 164 faces another portion of the space A1 except for the right portion, and controls the reciprocating motors 196 of the movable horizontal ducts 156 of the first right horizontal duct unit 162 in a backward moving mode so that the movable horizontal ducts 156 of the first right horizontal duct unit 162 slides to the left.

Figure 15:
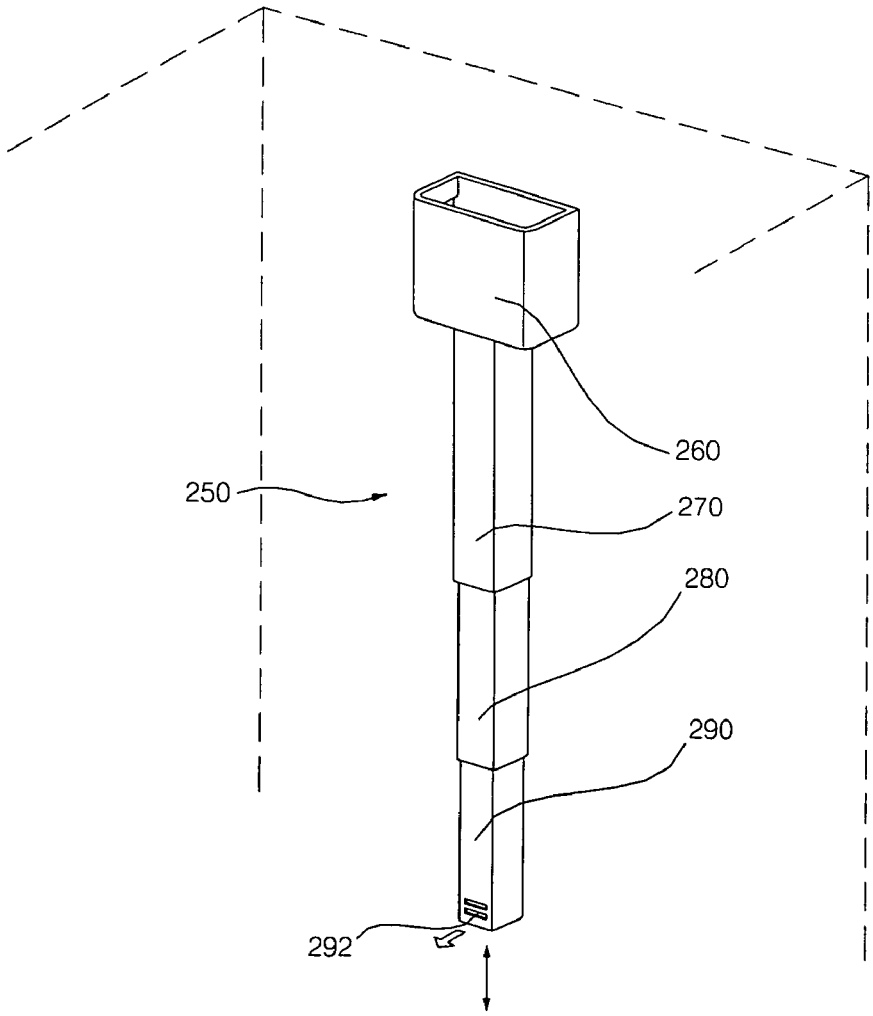
FIG. 15 is a perspective view of a cool air supply duct of a refrigerator in accordance with a fifth embodiment of the present invention.

FIG. 15 is a perspective view of a cool air supply duct of a refrigerator in accordance with a fifth embodiment of the present invention.

As shown in FIG. 15, the cool air supply duct of this embodiment comprises a vertical duct unit 250 installed in the vertical direction in the freezing chamber or the refrigerating chamber of the refrigerator so that the length of the vertical duct unit 250 is adjustable in the vertical direction.

The vertical duct unit 250 has a plurality of vertical ducts 260, 270, 280 and 290, at least one of which slides in the vertical direction.

The vertical ducts 260, 270, 280 and 290 are divided into one stationary vertical duct 260 fixedly installed in the freezing chamber or the refrigerating chamber, and movable vertical ducts 270, 280 and 290, at least one of which is slidably disposed on the stationary vertical duct 260 in the vertical direction.

The vertical duct unit 250 is configured such that one of the movable vertical ducts 270, 280 and 290 are slidably inserted into another of the movable vertical ducts 270, 280 and 290 in the vertical direction, and the sizes of the movable vertical ducts 270, 280 and 290 are gradually decreased in the direction of increasing the length of the vertical duct unit 250. Cool air discharge holes 292 are formed through the movable vertical duct 290 having the smallest size out of the movable vertical ducts 270, 280 and 290.

Figure 16:
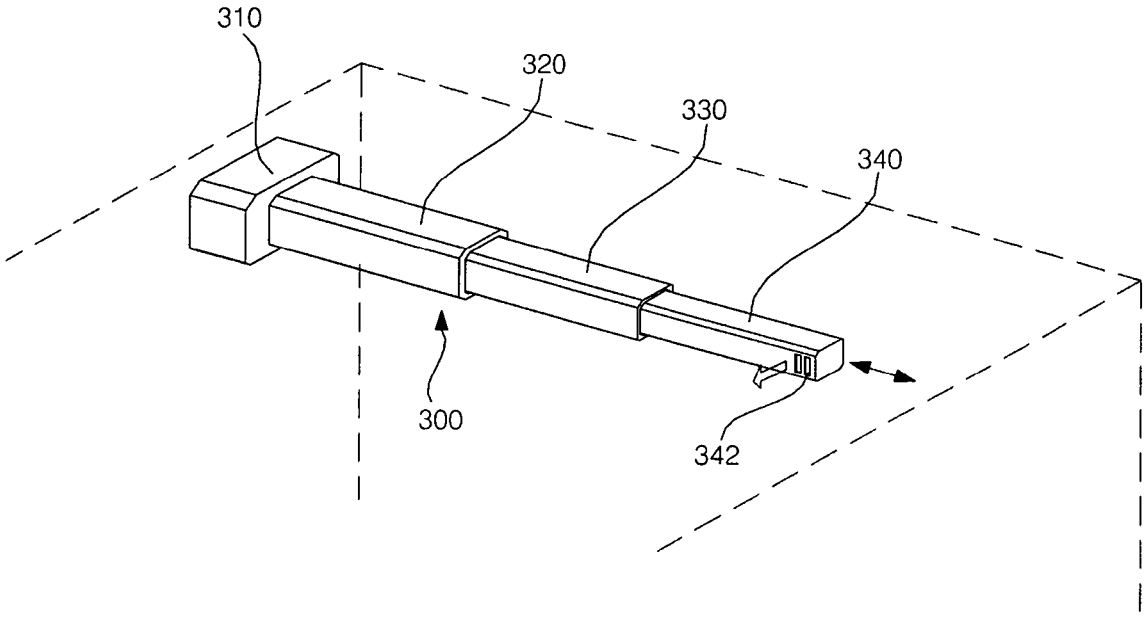
FIG. 16 is a perspective view of a cool air supply duct of a refrigerator in accordance with a sixth embodiment of the present invention.

FIG. 16 is a perspective view of a cool air supply duct of a refrigerator in accordance with a sixth embodiment of the present invention.

As shown in FIG. 16, the cool air supply duct of this embodiment comprises a horizontal duct unit 300 installed in the horizontal direction in the freezing chamber or the refrigerating chamber of the refrigerator so that the length of the horizontal duct unit 300 is adjustable in the horizontal direction.

The horizontal duct unit 300 has a plurality of horizontal ducts 310, 320, 330 and 340, at least one of which slides in the horizontal direction.

The vertical ducts 310, 320, 330 and 340 are divided into one stationary horizontal duct 310 fixedly installed in the freezing chamber and the refrigerating chamber, and movable horizontal ducts 320, 330 and 340, at least one of which is slidably disposed on the stationary horizontal duct 310 in the horizontal direction.

The horizontal duct unit 300 is configured such that one of the movable horizontal ducts 320, 330 and 340 are slidably inserted into another of the movable horizontal ducts 320, 330 and 340 in the horizontal direction, and the sizes of the movable horizontal ducts 320, 330 and 340 are gradually decreased in the direction of increasing the length of the horizontal duct unit 300. Cool air discharge holes 342 are formed through the movable horizontal duct 340 having the smallest size out of the movable horizontal ducts 320, 330 and 340.

Figure 17:
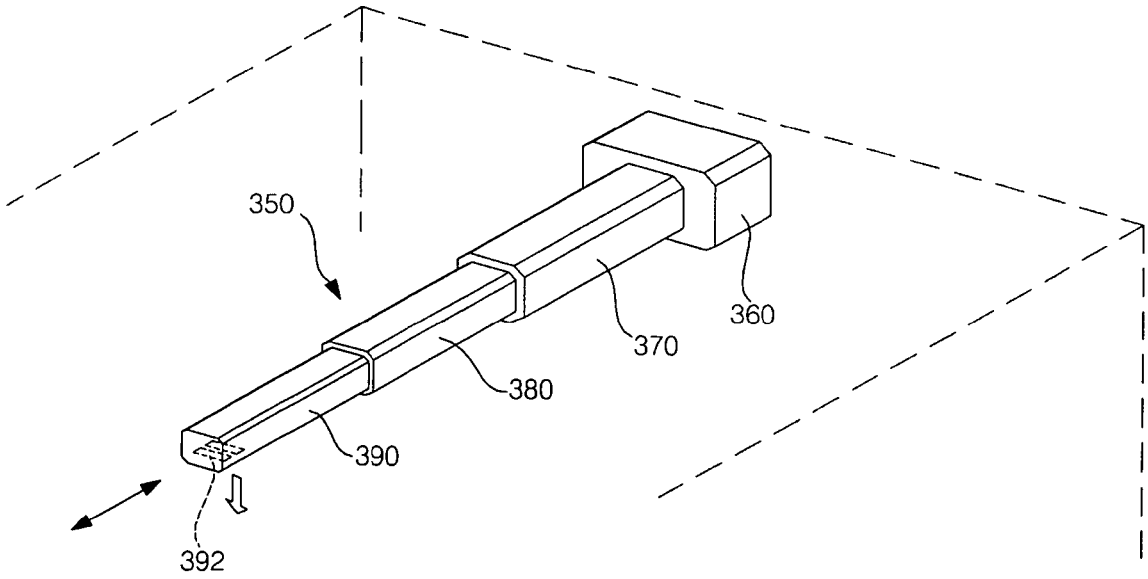
FIG. 17 is a perspective view of a cool air supply duct of a refrigerator in accordance with a seventh embodiment of the present invention.

FIG. 17 is a perspective view of a cool air supply duct of a refrigerator in accordance with a seventh embodiment of the present invention.

As shown in FIG. 17, the cool air supply duct of this embodiment comprises an anteroposterior duct unit 350 installed in the anteroposterior direction in the freezing chamber or the refrigerating chamber of the refrigerator so that the length of the traversing duct unit 350 is adjustable in the anteroposterior direction.

The anteroposterior duct unit 350 has a plurality of anteroposterior ducts 360, 370, 380 and 390, at least one of which slides in the anteroposterior direction.

The anteroposterior ducts 360, 370, 380 and 390 are divided into one stationary anteroposterior duct 360 fixedly installed in the freezing chamber and the refrigerating chamber, and movable anteroposterior ducts 370, 380 and 390, at least one of which is slidably disposed on the stationary anteroposterior duct 350 in the anteroposterior direction.

The anteroposterior duct unit 350 is configured such that one of the movable anteroposterior ducts 370, 380 and 390 are slidably inserted into another of the movable anteroposterior ducts 370, 380 and 390 in the anteroposterior direction, and the sizes of the movable anteroposterior ducts 370, 380 and 390 are gradually decreased in the direction of increasing the length of the anteroposterior duct unit 350. Cool air discharge holes 392 are formed through the movable anteroposterior duct 390 having the smallest size out of the movable anteroposterior ducts 370, 380 and 390.

Figure 18:
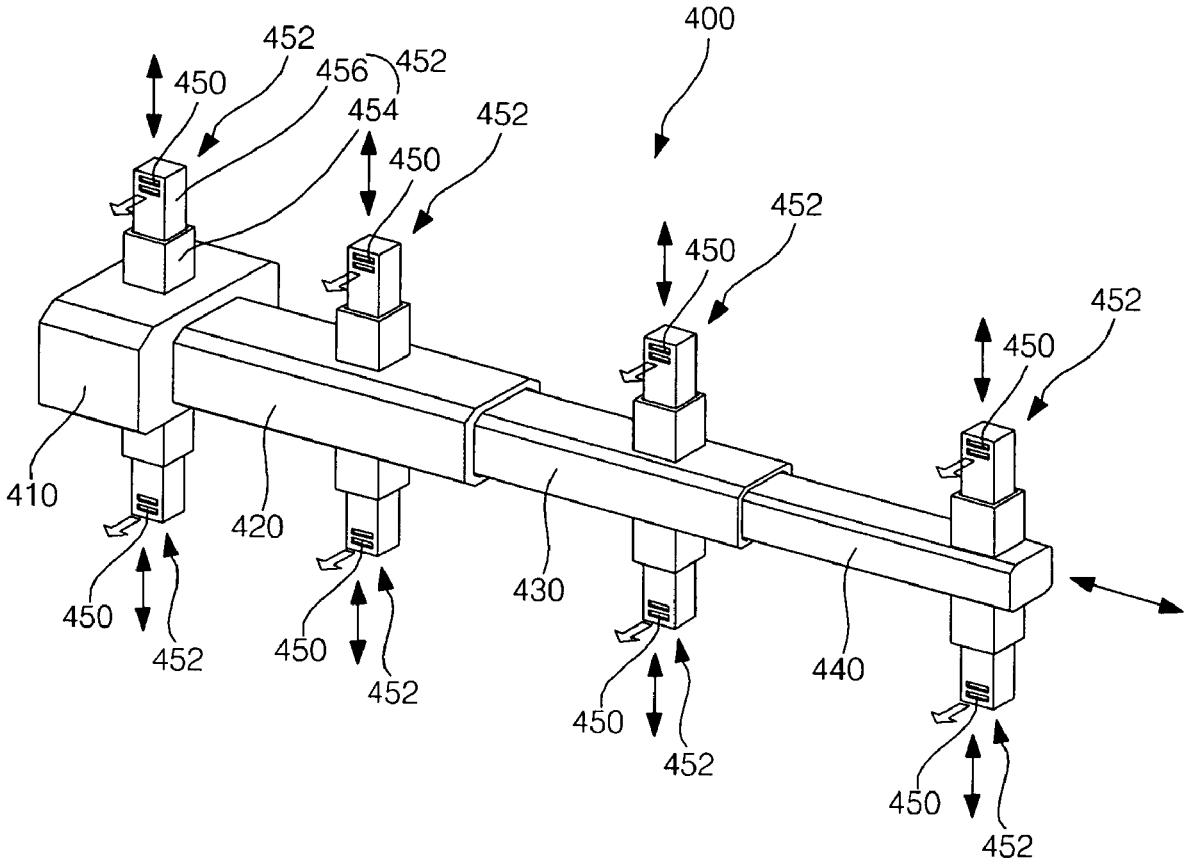
FIG. 18 is a perspective view of a cool air supply duct of a refrigerator in accordance with an eighth embodiment of the present invention.

FIG. 18 is a perspective view of a cool air supply duct of a refrigerator in accordance with an eighth embodiment of the present invention.

As shown in FIG. 18, the cool air supply duct of this embodiment comprises a horizontal duct unit 400 installed in the freezing chamber or the refrigerating chamber of the refrigerator so that the length of the horizontal duct unit 400 is adjustable in the horizontal direction, and vertical duct units 452 installed on the horizontal duct unit 400 so that the length of each of the vertical duct units 452 is adjustable in the vertical direction and provided with cool air discharge holes 450 formed therethrough.

The horizontal duct unit 400 has a stationary horizontal duct 410 fixedly installed in the freezing chamber or the refrigerating chamber, and movable horizontal ducts 420, 430 and 440, at least one of which is slidably disposed on the stationary horizontal duct 410 in the horizontal direction.

The stationary horizontal duct 410 is larger than the movable horizontal ducts 420, 430 and 440 so that the movable horizontal ducts 420, 430 and 440 are partially inserted into the stationary horizontal duct 410.

The movable horizontal ducts 420, 430 and 440 are configured such that they are slidably inserted into each other in the horizontal direction.

Preferably, the movable horizontal ducts 420, 430 and 440 have different sizes so that one of the movable horizontal ducts 420, 430 and 440 is partially inserted into another of the movable horizontal ducts 420, 430 and 440. More preferably, the sizes of the movable horizontal ducts 420, 430 and 440 are gradually decreased in the direction of increasing the length of the horizontal duct unit 400.

The vertical duct units 452 are protruded from upper and lower surfaces of the horizontal duct unit 400.

The vertical duct units 452 are protruded from all of the stationary and movable horizontal ducts 410, 420, 430 and 440 of the horizontal duct unit 400, and are disposed on the horizontal duct unit 400 such that the vertical duct units 452 are horizontally separated from each other.

That is, each of the vertical duct units 452 comprises a stationary vertical duct 454 communicated with the inside of the horizontal duct unit 400 and protruded from the horizontal duct unit 400, and a movable vertical duct 456 slidably inserted into the stationary vertical duct 454 and provided with cool air discharge holes 450 formed therethrough.

Figure 19:
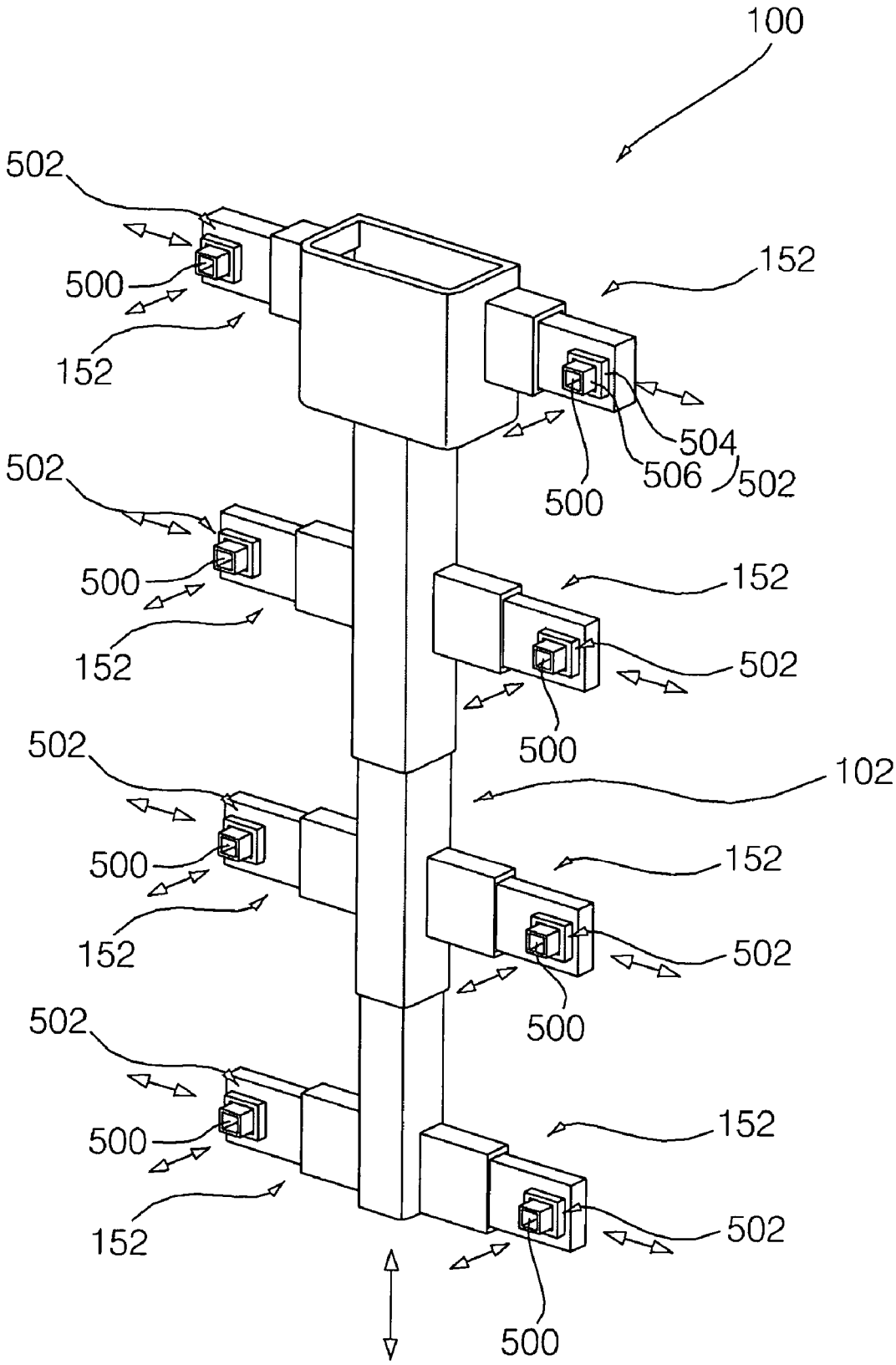
FIG. 19 is a perspective view of a cool air supply duct of a refrigerator in accordance with a ninth embodiment of the present invention.

FIG. 19 is a perspective view of a cool air supply duct of a refrigerator in accordance with a ninth embodiment of the present invention.

As shown in FIG. 19, the cool air supply duct of this embodiment comprises a vertical duct unit 102 installed in the freezing chamber or the refrigerating chamber of the refrigerator so that the length of the vertical duct unit 102 is adjustable in the vertical direction, horizontal duct units 152 installed on the vertical duct unit 102 so that the length of each of the horizontal duct units 152 is adjustable in the horizontal direction, and anteroposterior duct units 502 disposed on the corresponding horizontal duct units 152 so that the length of each of the anteroposterior duct units 502 is adjustable in the anteroposterior direction and provided with cool air discharge holes 500 formed therethrough. Through the above structure of the cool air supply duct, positions of the cool air discharge holes 500 can be three-dimensionally moved.

The vertical duct unit 102 and the horizontal duct units 152 of the cool air supply duct of this embodiment have the same structures as those of the cool air supply duct of the first embodiment.

Each of the anteroposterior duct units 502 has a stationary anteroposterior duct 504 communicated with the corresponding horizontal duct unit 152 and protruded from the corresponding horizontal duct unit 152, and a movable anteroposterior duct 506 slidably inserted into the stationary anteroposterior duct 504 and provided with the cool air discharge holes 500 formed therethrough.

The cool air supply duct of the present invention is not limited to the above embodiments, but may have the structure of a bellows hose so that the duct can be completely or partially extended or contracted. Further, the cool air supply duct of the present invention may be applied to a refrigerator having either of freezing and refrigerating chambers or a refrigerator having freezing and refrigerating chambers, which are vertically divided from each other.

Hereinafter, effects of the cool air supply duct of the refrigerator in accordance with present invention will be described.

Since the length of a duct unit provided with cool air discharge holes formed at a designated position thereof is adjustable, the cool air discharge holes can be moved to positions desired by a user by increasing or decreasing the length of the duct unit. Thereby, the cool air supply duct of the present invention can cool a designated space of a freezing chamber or a refrigerating chamber of the refrigerator to a temperature lower or higher than those of other spaces, thus increasing convenience in using the cool air supply duct and improving the cooling efficiency of the cool air supply duct.

When racks or food are located at positions closing the cool air discharge holes, the cool air discharge holes are moved to other positions by increasing or decreasing the length of the duct unit. Thereby, the cool air supply duct prevents food located at a designated space from rotting caused by the closing of the cool air discharge holes.

The cool air supply duct of the present invention is installed in the freezing chamber or the refrigerating chamber of the refrigerator, thus minimizing an adiabatic loss of the refrigerator.

Since the cool air discharge holes of the cool air discharge duct of the present invention are moved in the vertical and horizontal directions with two-dimensional freedom, the positions of the cool air discharge holes are arbitrarily changed.

Further, since the cool air discharge holes of the cool air discharge duct of the present invention are moved in the anteroposterior direction as well as in the vertical and horizontal directions with three-dimensional freedom, when the anteroposterior width of the freezing chamber or the refrigerating chamber is large, food is placed in the front portion of the freezing chamber or the refrigerating chamber and the cool air discharge holes can be moved to the front portion of the freezing chamber or the refrigerating chamber. Thereby, the cool air supply duct of the present invention effectively freezes/refrigerates the food and does not require a user to insert the food deeply to the rear portion of the freezing chamber or the refrigerating chamber.

Since one of a plurality of ducts of the duct unit is slidably inserted into another of a plurality of the ducts, the movement range of the air discharge holes is wide.

Since the length of at least one of a plurality of duct units is adjustable by user's instructions or according to the temperature of a designated space of the freezing chamber or the refrigerating chamber, the cool air supply duct of the present invention is conveniently used.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cool air supply duct of a refrigerator, comprising:

a vertical duct assembly installed in a freezing chamber or a refrigerating chamber of the refrigerator, the vertical duct assembly comprising a plurality of vertical ducts, at least one of which is disposed slidably in a vertical direction, so that a length of the vertical duct assembly can be adjusted in the vertical direction; and horizontal ducts installed on the vertical duct assembly and provided with cool air discharge holes formed therethrough for discharging cool air, at least one horizontal duct including a movable horizontal duct disposed slidably in a horizontal direction, so that the length of the at least one horizontal duct can be adjusted in the horizontal direction.

2. The cool air supply duct as set forth in claim 1, wherein second cool air discharge holes are formed through at least one of a plurality of the vertical ducts.

3. The cool air supply duct as set forth in claim 2, further comprising opening and closing members for opening and closing the second cool air discharge holes.

4. The cool air supply duct as set forth in claim 1, wherein a plurality of the vertical ducts comprises:

a stationary vertical duct fixedly installed in at least one of the freezing chamber and the refrigerating chamber; and movable vertical ducts, at least one of which is slidably installed on the stationary vertical duct in the vertical direction.

5. The cool air supply duct as set forth in claim 4, wherein the stationary vertical duct is larger than the movable vertical ducts so that the movable vertical ducts are partially inserted into the stationary vertical duct.

6. The cool air supply duct as set forth in claim 4, wherein the movable vertical ducts are slidably inserted into each other in the vertical direction.

7. The cool air supply duct as set forth in claim 6, wherein sizes of the movable vertical ducts are gradually decreased in a direction of increasing length of the vertical duct assembly so that one of the movable vertical ducts is partially inserted into another of the movable vertical ducts.

8. The cool air supply duct as set forth in claim 6, further comprising elevators for ascending and descending at least one of the movable vertical ducts.

9. The cool air supply duct as set forth in claim 1, wherein the horizontal ducts are disposed in parallel on at least one side of a left and right of the vertical duct assembly.

10. The cool air supply duct as set forth in claim 1, wherein the horizontal ducts are disposed on the vertical duct assembly so that the horizontal ducts are vertically separated from each other.

11. The cool air supply duct as set forth in claim 1, wherein each of the horizontal ducts comprises:

a stationary horizontal duct communicated with an inside of the vertical duct assembly and protruded from the vertical duct assembly; and a movable horizontal duct slidably inserted into the stationary horizontal duct and provided with the cool air discharge holes formed therethrough.

12. The cool air supply duct as set forth in claim 11, wherein the cool air discharge holes are formed through each of the movable horizontal ducts at designated positions so that the cool air discharge holes are closed by the stationary horizontal duct when the movable horizontal ducts are slidably inserted into the stationary horizontal ducts.

13. The cool air supply duct as set forth in claim 11, further comprising reciprocators for sliding the movable horizontal ducts in the horizontal direction.

14. A cool air supply duct of a refrigerator, comprising:

a stationary vertical duct fixedly installed in at least one of a freezing chamber and a refrigerating chamber of the refrigerator;

movable vertical ducts slidably installed on the stationary vertical duct in the vertical direction;

stationary horizontal ducts respectively protruded from both side surfaces of the stationary and movable vertical ducts; and movable horizontal ducts slidably disposed on corresponding stationary horizontal ducts and provided with cool air discharge holes formed therethrough for discharging cool air.

15. A cool air supply duct of a refrigerator, comprising:

cool air discharge holes for discharging cool air to at least one of a freezing chamber and a refrigerating chamber of the refrigerator; and a duct structure, a length of which is adjusted at least in an anteroposterior direction so that positions of the cool air discharge holes can be moved.

16. The cool air supply duct as set forth in claim 15, wherein the duct structure comprises a vertical duct assembly disposed in the vertical direction in at least one of the freezing chamber and the refrigerating chamber so that a length of a vertical duct assembly can be adjusted in the vertical direction.

17. The cool air supply duct as set forth in claim 15, wherein the duct structure comprises a horizontal duct disposed in a horizontal direction in at least one of the freezing chamber and the refrigerating chamber so that a length of the horizontal duct can be adjusted in the horizontal direction.

18. The cool air supply duct as set forth in claim 15, wherein the duct structure comprises an anteroposterior duct disposed in the anteroposterior direction in at least one of the freezing chamber and the refrigerating chamber so that a the length of the anteroposterior duct can be adjusted in the anteroposterior direction.

19. The cool air supply duct as set forth in claim 15, wherein the duct structure comprises:

a horizontal duct disposed in a horizontal direction in at least one of the freezing chamber and the refrigerating chamber so that a length of the horizontal duct can be adjusted in the horizontal direction; and vertical ducts disposed on the horizontal duct so that a length of each vertical duct of the vertical ducts can be adjusted in the vertical direction.

20. The cool air supply duct as set forth in claim 15, wherein the duct structure comprises:

a vertical duct disposed in a vertical direction in at least one of the freezing chamber the refrigerating chamber so that length of the vertical duct can be adjusted in the vertical direction;

horizontal ducts disposed on the vertical duct so that a length of each horizontal duct of the horizontal ducts can be adjusted in the horizontal direction; and anteroposterior ducts respectively disposed on the horizontal ducts so that a length of each anterposterior duct of the anteroposterior ducts can be adjusted in the anteroposterior direction and provided with the cool air discharge holes formed therethrough.

* * * * *